US010107171B2

(12) United States Patent
Ogino et al.

(10) Patent No.: US 10,107,171 B2
(45) Date of Patent: Oct. 23, 2018

(54) COOLING STRUCTURE OF INTERNAL COMBUSTION ENGINE

(71) Applicant: HONDA MOTOR CO., LTD., Tokyo (JP)

(72) Inventors: Hirotaka Ogino, Wako (JP); Takayuki Takatoku, Wako (JP); Yukio Konishi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 203 days.

(21) Appl. No.: 14/977,638

(22) Filed: Dec. 22, 2015

(65) Prior Publication Data

US 2016/0186641 A1 Jun. 30, 2016

(30) Foreign Application Priority Data

Dec. 24, 2014 (JP) ..... 2014-260103

(51) Int. Cl.
*F01P 7/16* (2006.01)
*F01P 3/02* (2006.01)
(Continued)

(52) U.S. Cl.
CPC ..... *F01P 3/02* (2013.01); *F01P 3/14* (2013.01); *F02F 1/38* (2013.01); *F02F 1/40* (2013.01); *F01P 7/16* (2013.01); *F01P 2003/024* (2013.01)

(58) Field of Classification Search
CPC ..... F01P 3/02; F01P 3/14; F01P 7/16
See application file for complete search history.

(56) References Cited

U.S. PATENT DOCUMENTS 7,438,026 B2 * 10/2008 Nakada ..... F01P 3/02 123/41.74
8,555,825 B2 * 10/2013 Lenz ..... F01P 3/02 123/193.3

(Continued)

FOREIGN PATENT DOCUMENTS

JP 08-028345 1/1996
JP 2001-289116 10/2001

(Continued)

OTHER PUBLICATIONS

Japanese Office Action for corresponding JP Application No. 2014-260103, dated May 10, 2016.

*Primary Examiner* — Jacob Amick
*Assistant Examiner* — Charles Brauch
(74) *Attorney, Agent, or Firm* — Mori & Ward, LLP

(57) ABSTRACT

A cooling structure of an internal combustion engine includes a cylinder block, an inner-block coolant passage, a cylinder head, and an inner-head coolant passage. In the cylinder block, cylinders are provided in a row in a cylinder row direction. The inner-head coolant passage is provided in the cylinder head and includes a main coolant passage, an upper exhaust side coolant passage, and a lower exhaust side coolant passage. The main coolant passage is provided above combustion chambers and extends in the cylinder row direction so that a coolant flows into the main coolant passage from the inner-block coolant passage at a first end side of the cylinder head in the cylinder row direction and so that the coolant flows out from the main coolant passage at a second end side of the cylinder head opposite to the first end side in the cylinder row direction.

25 Claims, 12 Drawing Sheets

(51) Int. Cl.

| | |
|---|---|
| ***F01P 3/14*** | (2006.01) |
| ***F02F 1/38*** | (2006.01) |
| ***F02F 1/40*** | (2006.01) |

(56) References Cited

U.S. PATENT DOCUMENTS

| | | | | |
|---|---|---|---|---|
| 2008/0314339 | A1* | 12/2008 | Koseki | F02F 1/4264 123/41.52 |
| 2009/0094965 | A1* | 4/2009 | Takewaki | F01N 13/004 60/299 |
| 2009/0126659 | A1* | 5/2009 | Lester | F01N 3/046 123/41.72 |
| 2011/0185716 | A1* | 8/2011 | Kawamoto | F01N 3/02 60/321 |
| 2012/0227686 | A1 | 9/2012 | D'Anna et al. | |
| 2012/0247410 | A1* | 10/2012 | Mukouhara | F01P 5/10 123/41.47 |

FOREIGN PATENT DOCUMENTS

| | | |
|---|---|---|
| JP | 2007-162519 | 6/2007 |
| JP | 2008-075507 | 4/2008 |
| JP | 2012-189075 | 10/2012 |
| JP | 2014-084739 | 5/2014 |

* cited by examiner

COOLING STRUCTURE OF INTERNAL COMBUSTION ENGINE

CROSS-REFERENCE TO RELATED APPLICATIONS

The present application claims priority under 35 U.S.C. § 119 to Japanese Patent Application No. 2014-260103, filed Dec. 24, 2014, entitled "Cooling Structure of Internal Combustion Engine." The contents of this application are incorporated herein by reference in their entirety.

BACKGROUND

1. Field

The present disclosure relates to a cooling structure of an internal combustion.

2. Description of the Related Art

Typically, in a multi-cylinder engine, a plurality of intake ports and exhaust ports are formed inside a cylinder head, and an intake manifold that distributes the intake air and an exhaust manifold that merges the exhaust air are joined to an intake side lateral surface and an exhaust side lateral surface, respectively, of the cylinder head. In recent years, there are multi-cylinder engines in which the exhaust collection portion that merges the exhaust air is formed inside the cylinder head such that a single exhaust outlet is formed in the exhaust side lateral surface of the cylinder head and a single exhaust pipe is joined to the cylinder head.

A multi-cylinder engine in which the exhaust collection portion is formed inside the cylinder head does not need to be provided with a separate exhaust manifold; accordingly, the engine as a whole can be reduced in size, the amount of heat discharge of the exhaust gas can be suppressed, and the temperature of the exhaust gas purifier at the time of warm up can be increased promptly, activating the catalyst. Furthermore, since the distance from the combustion chambers to the exit of the exhaust collection portion can be made short, when providing a supercharger (turbocharger) that uses exhaust gas, the response of the supercharger can be improved.

On the other hand, in a cylinder head in which the exhaust collection portion is formed therein, since the exposed area of the exhaust ports and the exhaust collection portion is large, the area in the vicinity of the exhaust collection portion needs to be cooled in order to prevent excessive increase in temperature. In a known cooling structure of an internal combustion engine that also cools the vicinity of an exhaust collection portion formed inside a cylinder head, in order to uniformly cool vicinities of combustion chambers and an exhaust manifold (the collection portion), water flows that flow in a direction orthogonal to a cylinder row direction are formed, and connection portions for continuously supplying a coolant to a three piece water jacket stacked in the cylinder axis direction are provided (see Japanese Unexamined Patent Application Publication No. 2012-189075).

SUMMARY

According to one aspect of the present invention, a cooling structure of an internal combustion engine includes a cylinder block and a cylinder head. In the cylinder block, a plurality of cylinders are formed in a row. The cylinder block has an inner-block coolant passage formed along an outer periphery of the plurality of cylinders. The cylinder head is fastened to an upper portion of the cylinder block so as to form combustion chambers between top faces of pistons that slide inside the cylinders. An inner-head coolant passage is formed in the cylinder head. A plurality of intake ports each having an upstream end that opens in one lateral side of the cylinder head and a downstream end that is open to a corresponding one of the combustion chambers, a plurality of exhaust ports each having an upstream end that opens to a corresponding one of the combustion chambers, and an exhaust collection portion that merges the plurality of exhaust ports and that has an exhaust outlet open in another lateral side of the cylinder head are formed in the cylinder head. The inner-head coolant passage includes a main coolant passage formed in a portion above the combustion chambers, and a pair of upper and lower exhaust side coolant passages that are formed so as to interpose the exhaust collection portion. The main coolant passage, and the pair of upper and lower exhaust side coolant passages are separated from each other. The main coolant passage circulates a coolant in a unidirectional manner such that the coolant flows from the inner-block coolant passage into one end side in a cylinder row direction and out from another end side in the cylinder row direction. The pair of upper and lower exhaust side coolant passages circulate the coolant such that the coolant flows from the inner-block coolant passage into one of the exhaust side coolant passages at the another end side in the cylinder row direction, circulates from the one of the exhaust side coolant passages to other one of the exhaust side coolant passages at the one end side in the cylinder row direction, and flows out from the other one of the exhaust side coolant passages at the another end side in the cylinder row direction.

According to another aspect of the present invention, a cooling structure of an internal combustion engine includes a cylinder block and a cylinder head. In the cylinder block, a plurality of cylinders are formed in a row. The cylinder block has an inner-block coolant passage formed along an outer periphery of the plurality of cylinders. The cylinder head is fastened to an upper portion of the cylinder block so as to form combustion chambers between top faces of pistons that slide inside the cylinders. An inner-head coolant passage is formed in the cylinder head. A plurality of intake ports each having an upstream end that opens in one lateral side of the cylinder head and a downstream end that is open to a corresponding one of the combustion chambers, a plurality of exhaust ports, two upstream ends of the plurality of exhaust ports being open to each combustion chamber, an exhaust collection portion that merges the plurality of exhaust ports and that has an exhaust outlet open in another lateral side of the cylinder head, and a plurality of exhaust valve guide portions that support exhaust valves that open and close connection portions between the exhaust ports and the combustion chambers are formed in the cylinder head. The inner-head coolant passage includes a main coolant passage formed in a portion above the combustion chambers, and a pair of upper and lower exhaust side coolant passages that are formed so as to interpose the exhaust collection portion. At least an upper exhaust side coolant passage of the exhaust side coolant passages is separated from the main coolant passage, is formed so as to surround the plurality of exhaust valve guide portions individually, and is configured to circulate a coolant in a cylinder row direction. The upper exhaust side coolant passage of the exhaust side coolant passages includes a main passage that is formed on the another lateral side of the cylinder head with respect to the plurality of exhaust valve guide portions, an end portion passage that is formed so as to extend in the cylinder row direction and on the one lateral side of the cylinder head with respect to the plurality of exhaust valve guide portions, and a communication passage formed so as to communicate the main passage and the end portion passage to each other at a portion between adjacent exhaust valve guide portions. In each cylinder, a cross-sectional area of a portion of the end portion passage that is in contact with an exhaust valve guide portion of the exhaust valve guide portions that is positioned on an upstream side of the coolant is larger than a cross-sectional area of a portion of the end portion passage that is in contact with an exhaust valve guide portion of the exhaust valve guide portions that is positioned on a downstream side.

According to further aspect of the present invention, a cooling structure of an internal combustion engine includes a cylinder block, an inner-block coolant passage, a cylinder head, and an inner-head coolant passage. In the cylinder block, cylinders are provided in a row in a cylinder row direction. The inner-block coolant passage is provided in the cylinder block along an outer periphery of the cylinders. A coolant is to flow through the inner-block coolant passage. The cylinder head is connected to an upper portion of the cylinder block so as to provide combustion chambers between the cylinder head and top faces of pistons that are slidable inside the cylinders. The cylinder head includes an intake lateral side surface, an exhaust lateral side surface, intake ports, exhaust ports, and an exhaust collection portion. The intake ports each have an upstream end and a downstream end. The upstream end opens on the intake lateral side surface. The downstream end opens to one of the combustion chambers. The exhaust ports each have an upstream end that opens to one of the combustion chambers. The exhaust collection portion merges the exhaust ports and has an exhaust outlet that opens on the exhaust lateral side surface. The inner-head coolant passage is provided in the cylinder head and includes a main coolant passage, an upper exhaust side coolant passage, and a lower exhaust side coolant passage. The main coolant passage is provided above the combustion chambers and extends in the cylinder row direction so that the coolant flows into the main coolant passage from the inner-block coolant passage at a first end side of the cylinder head in the cylinder row direction and so that the coolant flows out from the main coolant passage at a second end side of the cylinder head opposite to the first end side in the cylinder row direction. The upper exhaust side coolant passage and the lower exhaust side coolant passage are provided so as to interpose the exhaust collection portion, are separated from the main coolant passage, and extend in the cylinder row direction so that the coolant flows into one of the upper and the lower exhaust side coolant passages from the inner-block coolant passage at the second end side, so that the coolant circulates from the one of the upper and the lower exhaust side coolant passages to other one of the upper and the lower exhaust side coolant passages at the first end side, and so that the coolant flows out from the other one of the upper and the lower exhaust side coolant passages at the second end side.

According to the other aspect of the present invention, a cooling structure of an internal combustion engine includes a cylinder block, an inner-block coolant passage, a cylinder head, and an inner-head coolant passage. In the cylinder block, cylinders are provided in a row in a cylinder row direction. The inner-block coolant passage is provided in the cylinder block along an outer periphery of the cylinders. The cylinder head is connected to an upper portion of the cylinder block so as to provide combustion chambers between the cylinder head and top faces of pistons that are slidable inside the cylinders. The cylinder head includes an intake lateral side surface, an exhaust lateral side surface, intake ports, exhaust ports, an exhaust collection portion, and exhaust valve guide portions. The intake ports each have an upstream end and a downstream end. The upstream end opens on the intake lateral side surface. The downstream end opens to one of the combustion chambers. The exhaust ports each have two upstream ends that open to one of the combustion chambers. The exhaust collection portion merges the exhaust ports and has an exhaust outlet that opens on the exhaust lateral side surface. The exhaust valve guide portions support exhaust, valves provided to open and close connection portions between the exhaust ports and the combustion chambers. The inner-head coolant passage is provided in the cylinder head and includes a main coolant passage, an upper exhaust side coolant passage, and a lower exhaust side coolant passage. The main coolant passage is provided above the combustion chambers. The upper exhaust side coolant passage and the lower exhaust side coolant passage are provided so as to interpose the exhaust collection portion. The upper exhaust side coolant passage is separated from the main coolant passage, is provided so as to surround each of the exhaust valve guide portions, and extends in the cylinder row direction so that a coolant circulates through the upper exhaust side coolant passage in the cylinder row direction. The upper exhaust side coolant passage includes a main passage, an end portion passage, and a communication passage. The main passage is provided on a side of the exhaust lateral side surface of the cylinder head with respect to the exhaust valve guide portions. The end portion passage is provided on a side of the intake lateral side surface of the cylinder head with respect to the exhaust valve guide portions so as to extend in the cylinder row direction. The communication passage is provided so as to connect the main passage and the end portion passage between a first exhaust valve guide portion and a second exhaust valve guide portion which are among the exhaust valve guide portions and which are adjacent to each other above one of the cylinders. The first exhaust valve guide portion and the second exhaust valve guide portion are positioned on an upstream side of the coolant and on a downstream side of the coolant, respectively. A cross-sectional area of a first portion of the end portion passage that is in contact with the first exhaust valve guide portion is larger than a cross-sectional area of a second portion of the end portion passage that is in contact with the second exhaust valve guide portion.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENTS

Figure 1:
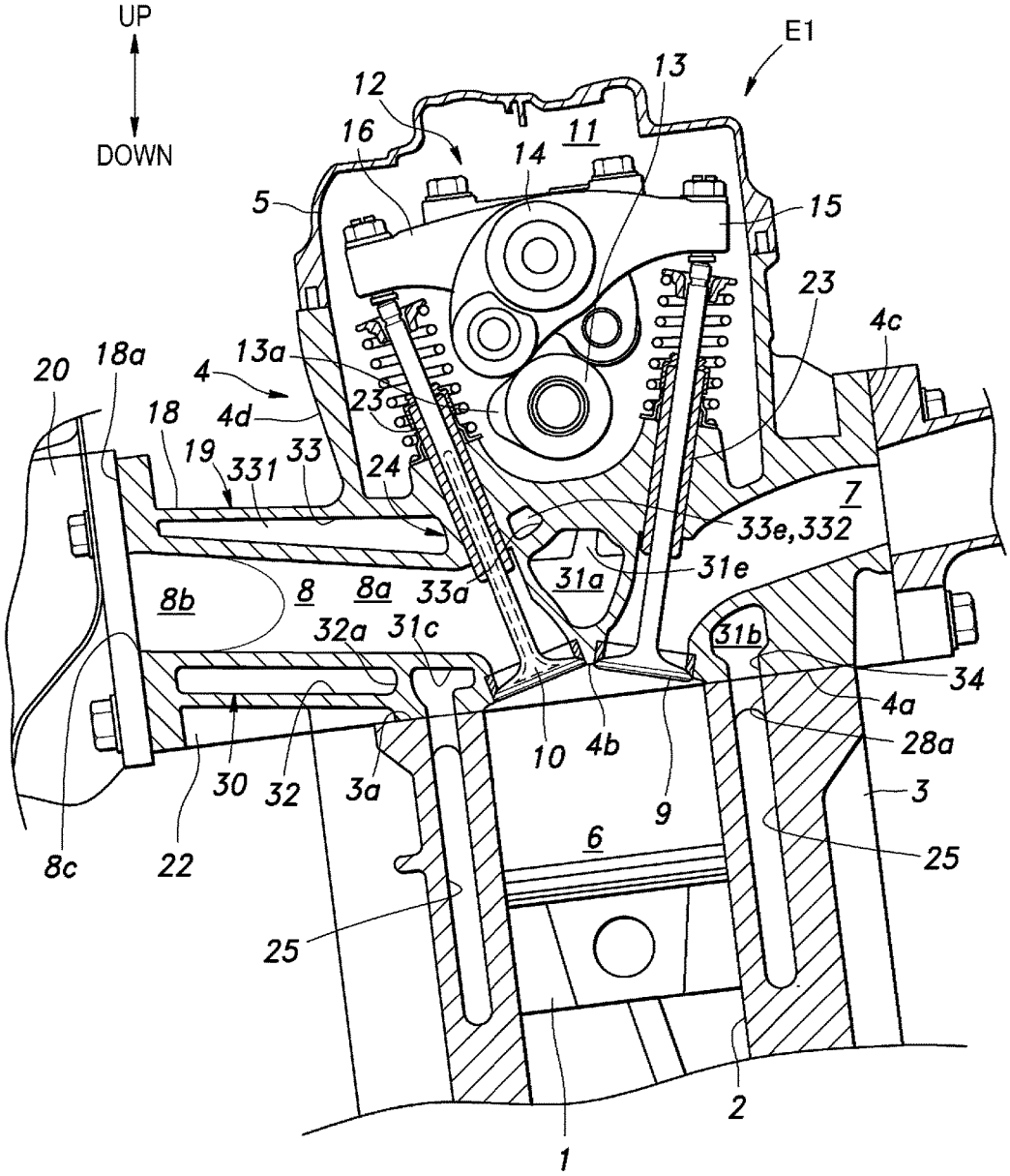
FIG. 1 is a cross-sectional view of an essential portion of an engine according to a first exemplary embodiment viewed in the cylinder row direction.

The embodiments will now be described with reference to the accompanying drawings, wherein like reference numerals designate corresponding or identical elements throughout the various drawings.

Hereinafter, two exemplary embodiments which have been applied to vehicular internal combustion engines (hereinafter, each merely referred to as an "engine") will be described in detail with reference to the drawings.

First Exemplary Embodiment

A first exemplary embodiment will be described first with reference to FIGS. 1 to 5. Hereinafter, description will be given with reference to FIG. 1 illustrating, in the up-down direction, an engine E1 that is mounted in a vehicle, which will be the standard state herein.

As illustrated in FIG. 1, the engine E1 is an SOHC, 4-valve, in-line 3 cylinder, gasoline engine. As illustrated in FIG. 1, the engine E1 includes a cylinder block 3 in which three cylinders 2 that accommodate pistons 1 are formed in a row, a box-shaped cylinder head 4 that is fastened to an upper portion of the cylinder block 3, and a head cover 5 that is fastened to an upper portion of the cylinder head 4. The engine E1 is mounted in the vehicle in such a position that the cylinder head 4 is disposed on the upper side in the vertical direction. The cylinder block 3 and the cylinder head 4 are casted from aluminum alloy.

The cylinders 2 each extend in a substantially up-down direction and are formed parallel to each other in the cylinder block 3. More specifically, the cylinders 2 are each somewhat inclined with respect to a vertical line such that the upper sides fall to the left side of the drawing. Hereinafter, the row direction of the plurality of cylinders 2 provided in a row will be referred to as a cylinder row direction. An upper end of each of the cylinders 2 is open in an upper surface 3*a* of the cylinder block 3, and a lower end thereof is open to a crankcase (not shown) formed in the lower portion of the cylinder block 3.

Combustion chamber recesses 4*b* that are curved-shaped depressions are formed on the surface (hereinafter, referred to as a head-block joint surface 4*a*) of the cylinder head 4, which is joined to the cylinder block 3, at portions that face the cylinders 2. Together with portions of the cylinders 2 above the pistons 1, the combustion chamber recesses 4*b* define combustion chambers 6. In other words, the combustion chambers 6 are formed between the cylinder heads 4 and the top faces of the pistons 1 that slide inside the cylinders 2.

Three intake ports 7, an upstream end of each of the three intake ports 7 being open in one lateral side 4*c* (the lateral side on the right side in FIG. 1, an intake lateral side surface) of the cylinder head 4, the one lateral side 4*c* extending in the cylinder row direction, and downstream ends of each of the three intake ports 7 that branch into two being open in two portions in each wall surface that defines the corresponding combustion chamber recesses 4*b*; and a single exhaust collection port 8, upstream ends of the single exhaust collection port 8 being open in two portions in each wall surface that defines the corresponding combustion chamber recesses 4*b* and a downstream end of the single exhaust collection port 8 being open in the other lateral side 4*d* (the lateral side on the left side in FIG. 1, an exhaust lateral side surface) of the cylinder head 4, the other lateral side 4*d* extending in the cylinder row direction, are formed inside the cylinder head 4. The exhaust collection port 8 includes, inside the cylinder head 4, the plurality of (three) exhaust ports 8*a*, each being provided in the corresponding cylinder 2, the upstream end of each of the exhaust ports 8*a* being branched into two and being open in the corresponding combustion chamber recess 4*b*; and the exhaust collection portion 8*b* that collects all of the exhaust ports 8*a*. The exhaust collection portion 8*b* forms a single exhaust outlet 8*c* in the other lateral side 4*d* of the cylinder head 4. With respect to the combustion chamber recesses 4*b*, the side in which the intake ports 7 is provided is the intake side and the side in which the exhaust collection port 8 is provided is the exhaust side.

In a section (FIG. 1) orthogonal to the cylinder row direction, the intake ports 7 and the exhaust collection port 8 are inclined with respect to the directions orthogonal to the cylinder axes. As described above, since the upstream sides of the cylinders 2 are inclined so as to fall to the left side (the exhaust side), in a direction orthogonal to the cylinder row direction, the direction in which the exhaust collection port 8 extends is closer to a horizontal angle when compared with the directions in which the intake ports 7 extend.

The cylinder head 4 is provided with, in a slidable manner through valve guides 23, six intake valves 9 that open and close the connection portions between the intake ports 7 and the combustion chambers 6 and six exhaust valves 10 that open and close the connection portions between the exhaust collection port 8 and the combustion chambers 6. A valve chamber 11 is defined between the cylinder head 4 and the head cover 5 with the cylinder head 4 and the head cover 5, and a valve gear 12 that drives and opens the intake valves 9 and the exhaust valves 10 is accommodated in the valve chamber 11. The valve gear 12 includes a camshaft 13 that is attached to the cylinder head 4 in a rotatable manner, a rocker shaft 14 that is disposed above the camshaft 13, intake rocker arms 15 and exhaust rocker arms 16 that are supported by the rocker shaft 14 in a swingable manner. Valve cams 13*a* that each drive a pair of intake valve 9 and exhaust valve 10 in each cylinder 2 is formed on the camshaft 13.

The exhaust outlet 8*c* is provided in an intermediate position in the longitudinal direction of the other lateral side 4*d* on the exhaust side of the cylinder head 4. In other words, FIG. 1 illustrates a section of the cylinder 2 disposed in the middle among the three cylinders 2. Furthermore, at the middle of each of the total of four ports, namely, the intake ports 7 and exhaust collection port 8, that are open in the wall surface of the corresponding combustion chamber recess 4*b*, a spark plug insertion hole (not shown) for inserting a spark plugs (not shown) is formed so as to penetrate through the bottom wall of the cylinder head 4 and open in the upper facing surface of the cylinder head 4.

The exhaust collection portion 8*b* is formed on the exhaust side with respect to the head-block joint surface 4*a* of the cylinder head 4. More specifically, the exhaust outlet 8*c* is defined by a tube-shaped exhaust outlet tubular portion 18 that protrudes from the other lateral side 4*d* of the cylinder head 4 on the exhaust side, and the exhaust outlet tabular portion 18 of the cylinder head 4 and the vicinity thereof configure a bulging portion 19 that forms the exhaust collection portion 8*b* that bulges laterally with respect to the cylinder block 3.

An end surface 18*a* of the exhaust outlet tubular portion 18 serve as a surface joined with a downstream-side exhaust passage member 20, such as a turbine of a supercharger (a turbocharger) or an exhaust emission control device (not shown). The downstream-side exhaust passage member 20 is fastened to the end surface 18*a* of the exhaust outlet tubular portion 18 with four bolts 21 that are disposed so as to surround the exhaust outlet 8*c*. In an underside of the bulging portion 19, two ribs 22 are formed for fastening two bolts 21 on the lower side from the periphery of the head-block joint surface 4*a* to the fastening bosses (not shown). With the above, deformation of the bulging portion 19 can be suppressed.

Inside the cylinder block 3, in the outer peripheral portion of each of the cylinders 2, an inner-block coolant passage 25 (a water jacket) is formed so as to suppress increase in temperature due to heat inside the corresponding combustion chamber 6 transmitted through the combustion gas. The inner-block coolant passage 25 is formed so as to curve along the outer peripherals of the cylinders 2. At least a portion of an upper end of the inner-block coolant passage 25 is open to the upper surface 3*a* of the cylinder block 3. The inner-block coolant passage 25 includes a cavity that is formed by a core such as a sandmold during molding of the cylinder block 3 so as to circulate a coolant, such as cooling water, oil, or a refrigerant.

Inside the cylinder head 4, inner-head coolant passages 30 (31 to 38, inner-head water jackets) are formed in the vicinity of the combustion chamber recesses 4*b*, the intake ports 7, and the exhaust collection port 8, so as to suppress increase in the temperature due to heat inside the combustion chambers 6 and the exhaust collection port 8 transmitted through the combustion gas. At least a portion of the lower end of each of the inner-head coolant passages 30 is formed so as to be open to an underside of the cylinder head 4 at a position corresponding to the upper end opening of the inner-block coolant passage 25. Each inner-head coolant passage 30 also includes a cavity that is formed by a core such as a sandmold during molding of the cylinder head 4 so as to circulate the coolant.

Figure 2:
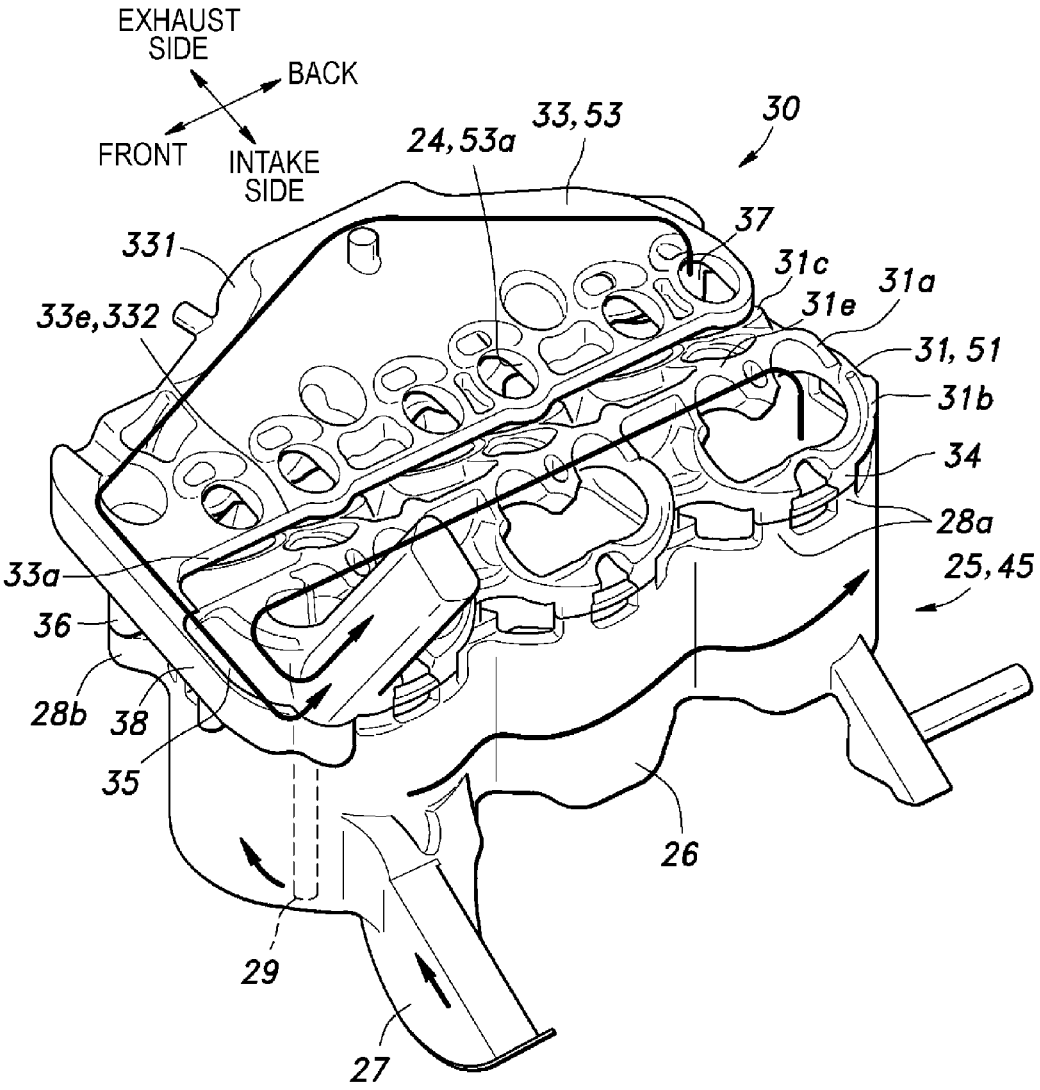
FIG. 2 is a perspective view of cores for an inner-block coolant passage and an inner-head coolant passage.
Figure 3:
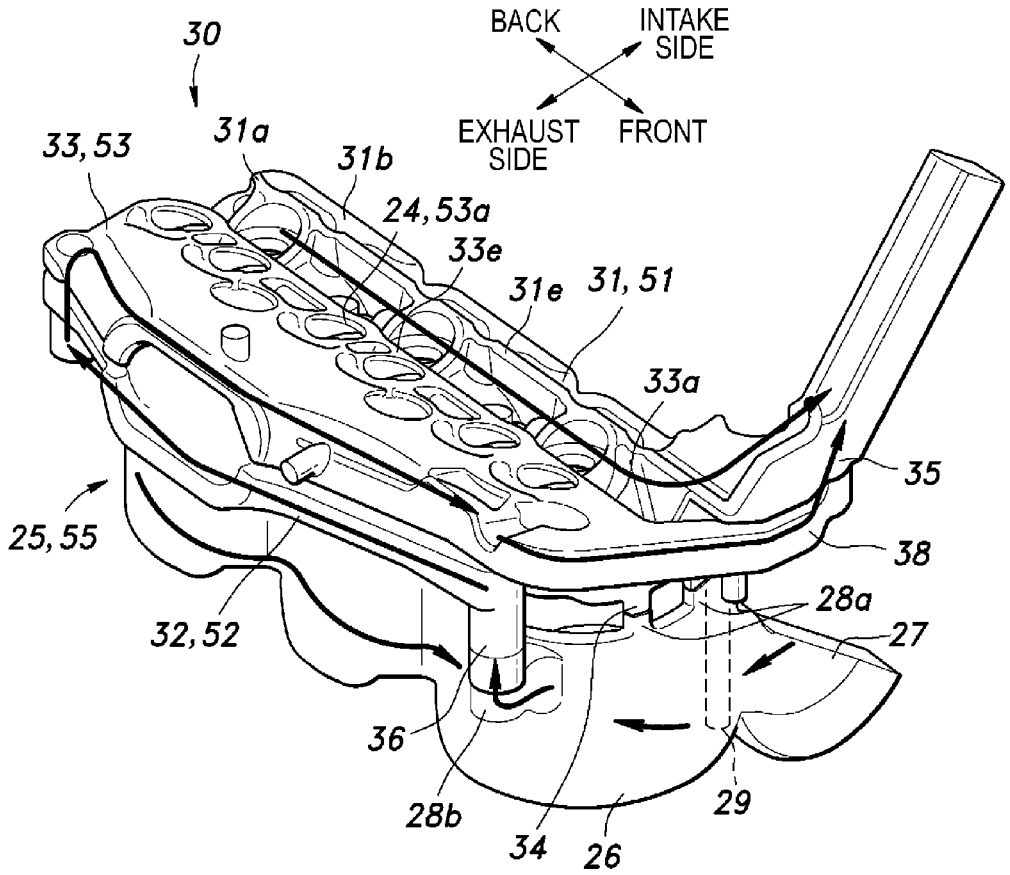
FIG. 3 is a perspective view of the cores for the inner-block coolant passage and the inner-head coolant passage.

FIGS. 2 and 3 are diagrams illustrating cores for the inner-block coolant passage 25 and the inner-head coolant passages 30 that are used when casting the cylinder head 4. In other words, FIGS. 2 and 3 are similar to physically illustrating the inner-block coolant passage 25 and the inner-head coolant passages 30 that are cavities, while the cylinder block 3 and the cylinder head 4 are seen through. Hereinafter, description will be made as the description of the inner-block coolant passage 25 and the inner-head coolant passages 30, and in the drawings, reference numerals of the cores will be denoted in parentheses.

The inner-block coolant passage 25 is formed by a core 45 for inner-block coolant passage. The inner-block coolant passage 25 includes a passage body portion 26 configured as a substantially annular cavity that surrounds the three cylinders 2 and that is in communication with a relatively small cross-sectional area between adjacent cylinders 2, and a coolant inlet port 27 that is connected to one end side of the passage body portion 26 in the cylinder row direction and on the intake side and that flows the coolant sent from a coolant pump (not shown) into the passage body portion 26. Block outlet ports 28 (28*a* and 28*b*) that are outlet ports of the coolant of the inner-block coolant passage 25 are configured of portions that open in the upper surface 3*a* of the cylinder block 3 described above. Hereinafter, description will be given while, in the cylinder row direction, the side in which the coolant inlet port 27 is provided is the front and the opposite side is the back.

In detail, the block outlet ports 28 include a plurality of block first outlet ports 28*a* that are formed at substantially equal intervals in the circumferential direction of the passage body portion 26 so as to extend upwards from the upper ends of the passage body portion 26, and a block second outlet port 28*b* that, after protruding towards the exhaust side from a portion on the intake side and on the lateral side of the front side of the passage body portion 26, extends upwards. Among the plurality of block first outlet ports 28*a*, those disposed on the intake side are in communication with an intake side portion 31*b* of a main coolant passage 31 described later, and those disposed on the exhaust side are in communication with an exhaust side portion 31*c* of the main coolant passage 31 described later. The block second outlet port 28*b* is in communication with a lower exhaust side coolant passage 32 described later.

A partition member 29 is inserted from above into the passage body portion 26 at a portion on the front end side with respect to the position where the coolant inlet port 27 is connected. The passage body portion 26 is partitioned at the front end side with the partition member 29. The partition member 29 is a bar-like member including an elastic body on at least the surface portion. The partition member 29 is disposed such that the upper end is flush with the upper surface 3*a* of the cylinder block 3 and such that a gap is formed on the lower end. With the above, the gap on the lower side of the partition member 29 (in other words, a deficit portion of the partition member 29) communicates the intake side and the exhaust side of the passage body portion 26 with each other through a relatively small cross-sectional area.

The inner-head coolant passages 30 include the main coolant passage 31 that extends in the front-back direction (the cylinder row direction) so as to pass through the upper vicinity of the plurality of combustion chamber recesses 4*b*, and the lower exhaust side coolant passage 32 (FIG. 3) and an upper exhaust side coolant passage 33 that extends in the front-back direction and that are disposed so as to interpose the exhaust collection portion 8*b* (FIG. 1) from above and below. The main coolant passage 31 is formed with a core 51 for main coolant passage, the lower exhaust side coolant passage 32 is formed with a core 52 for lower exhaust side coolant passage, and the upper exhaust side coolant passage 33 is formed with a core 53 for upper exhaust side coolant passage. Note that the lower exhaust side coolant passage 32 and the upper exhaust side coolant passage 33 may be formed with a single core for exhaust side cooling passages. Hereinafter, when collectively referring to the lower exhaust side coolant passage 32 and the upper exhaust side coolant passage 33, the lower exhaust side coolant passage 32 and the upper exhaust side coolant passage 33 will be merely referred to as exhaust side coolant passages 32 and 33.

The essential portions of the main coolant passage 31 includes a main portion 31*a* formed between the intake ports 7 (FIG. 1) and the exhaust ports 8*a*, the intake side portion 31*b* that is formed below the intake ports 7, and the exhaust side portion 31*c* that is formed below the exhaust ports 8*a*. The main portion 31*a* and the intake side portion 31*b*, and the main portion 31*a* and the exhaust side portion 31*c* are in communication with each other through lateral communication passages (no reference numerals) that are formed between the front ends and between the back ends of the above, and between two adjacent cylinders 2.

Figure 4:
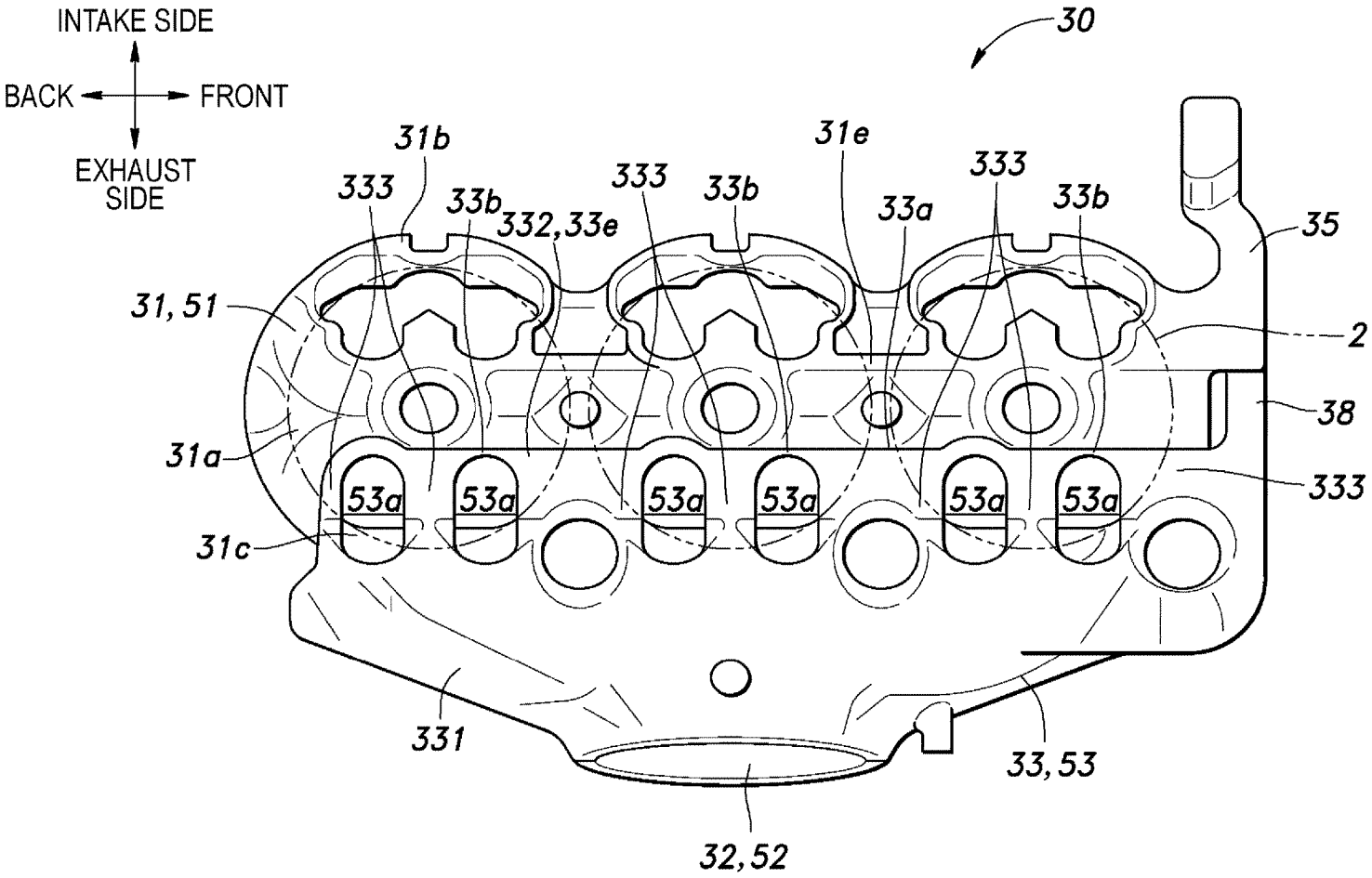
FIG. 4 is a top view illustrating the inner-block coolant passage and the inner-head coolant passage in an actual manner.
Figure 5:
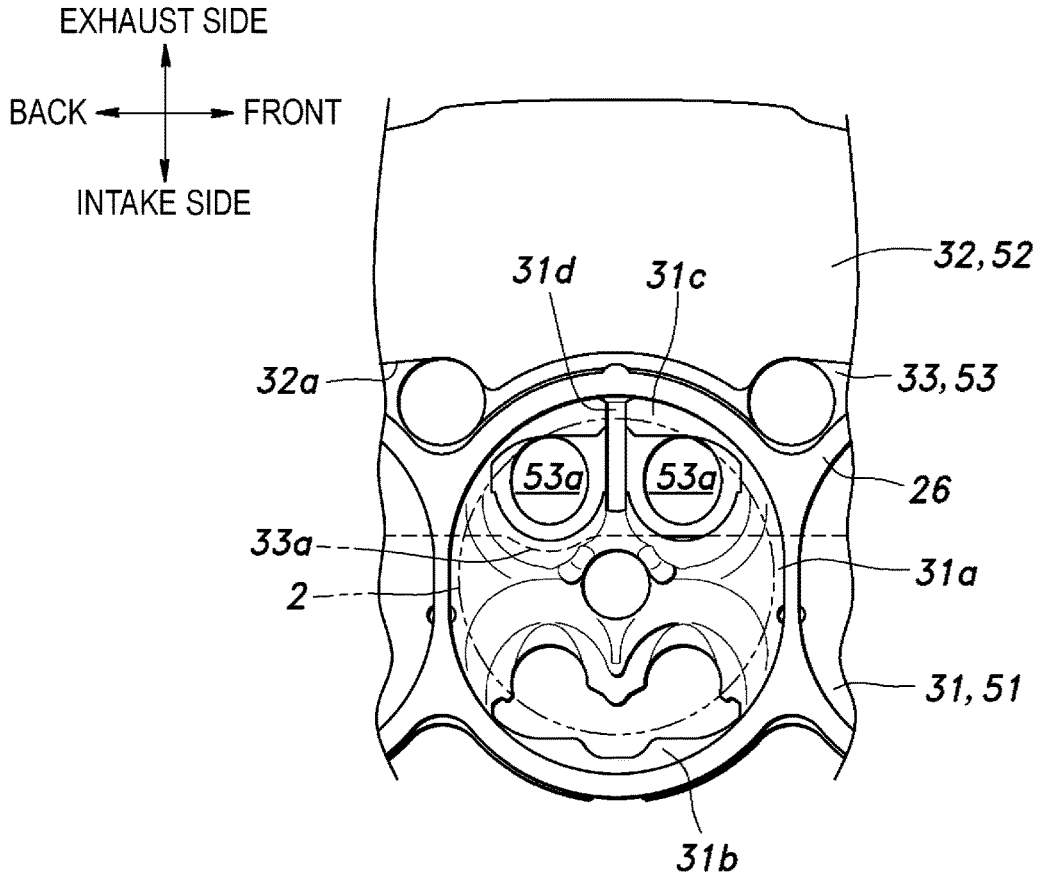
FIG. 5 is a bottom view illustrating the inner-block coolant passage and the inner-head coolant passage in an actual manner.

FIG. 4 is a top view illustrating the inner-block coolant passage 25 and the inner-head coolant passages 30 in an actual manner, and FIG. 5 is a bottom view of the above. As illustrated in FIG. 5, in addition to the lateral communication passages between two adjacent cylinders 2 that are formed with the core 45 for inner-block coolant passage described above, the main portion 31*a* and the exhaust side portion 31*c* are in communication with each other through lateral connection passages 31*d* that are formed between branched portions of the exhaust ports 8*a* in each of the three exhaust ports 8*a*. The lateral connection passages 31*d* are formed by drilling after the casting of the cylinder head 4. By forming the lateral connection passages 31*d*, the vicinities of the exhaust valve seats, where the heat inside the combustion chambers 6 and the exhaust ports 8*a* is transmitted through the combustion gas, can be effectively cooled.

Referring back to FIGS. 2 and 3, main cylinder inlet ports 34 that protrude downwards are formed in the main coolant passage 31 at portions corresponding to the block first outlet ports 28*a* of the inner-block coolant passage 25. A main coolant outlet port 35 that discharges the coolant inside the main coolant passage 31 is formed on the front side of the main coolant passage 31 so as to protrude upwards towards the intake side from the main portion 31*a* and the intake side portion 31*b*.

An upper end portion of the main portion 31*a* positioned at the highest in the main coolant passage 31 has a substantially straight shape that extends horizontally in the front-back direction and serves as a main air bleeding passage 31*e* that is an air bleeding passage of the main coolant passage 31.

An exhaust side cylinder inlet port 36 that is connected to the block second outlet port 28*b* of the inner-block coolant passage 25 is formed so as to protrude downwards at the front end of the lower exhaust side coolant passage 32. The lower exhaust side coolant passage 32 is in communication with the inner-block coolant passage 25 only through the exhaust side cylinder inlet port 36. The lower exhaust side coolant passage 32 is not in communication with the main coolant passage 31.

The lower exhaust side coolant passage 32 and the upper exhaust side coolant passage 33 are in communication with each other through a vertical communication passage 37 (FIG. 2) that are formed at the back end. The upper exhaust side coolant passage 33 is in communication with the lower exhaust side coolant passage 32 only through the vertical communication passage 37. The upper exhaust side coolant passage 33 is not in communication with the inner-block coolant passage 25 and the main coolant passage 31. In other words, the main coolant passage 31, and the exhaust side coolant passages 32 and 33 are separated from each other.

An exhaust side coolant outlet port 38 that discharges the coolant inside the upper exhaust side coolant passage 33 is formed so as to protrude towards the intake side at the front end of the upper exhaust side coolant passage 33. The exhaust side coolant outlet port 38 is formed so as to merge with the main coolant outlet port 35 from the lower side. The main coolant outlet port 35 and the exhaust side coolant outlet port 38 are connected to a coolant pipe passage 39 (see FIG. 8) that is connected to the cylinder head 4.

In other words, the main coolant outlet port 35 that is an outlet port of the coolant of the main coolant passage 31, the exhaust side coolant outlet port 38 that is an outlet port of the coolant of the exhaust side coolant passages 32 and 33, and the coolant inlet port 27 of the inner-block coolant passage 25 are all formed so as to open on the intake side with respect to the cylinders 2.

As illustrated with FIGS. 1 and 5, an edge 32*a* of the lower exhaust side coolant passage 32 on the intake side is positioned outside the cylinders 2 and has a shape that extends along the outer edge of the main coolant passage 31 (31*c*) that extends along the shape of the cylinders 2, and the outer edge of the bolt boss for fastening when viewed in the cylinder axis direction (FIG. 5). Meanwhile, in the upper exhaust side coolant passage 33, an edge 33*a* on the intake side protrudes towards the intake side out to where the edge 33*a* overlaps the cylinders 2 when viewed in the cylinder axis direction (FIG. 5). Since in the portions where the exhaust valves 10 pass, exhaust valve guide portions 24 (FIG. 1) configured of the valve guides 23 (FIG. 1) that support the exhaust valves 10, and walls that support the valve guides 23 are present, through holes 53*a* are formed in the core 53 for upper exhaust side coolant passage. The through holes 53*a* are not formed as cutaways but are formed as holes. Accordingly, the upper exhaust side coolant passage 33 is formed so as to surround the exhaust valve guide portions 24 (FIG. 1) individually.

In other words, as illustrated with FIG. 4, the upper exhaust side coolant passage 33 includes a main passage 331 that is formed on the exhaust side (on the other lateral side 4*d* side of the cylinder head 4) with respect to the plurality of exhaust valve guide portions 24 (through holes 53*a*), an end portion passage 332 that is formed so as to extend in the cylinder row direction and on the intake side (on the one lateral side 4*c* side of the cylinder head 4) with respect to the plurality of exhaust valve guide portions 24, and a plurality of communication passages 333 that communicate the main passage 331 and the end portion passage 332 to each other. The end portion passage 332 that constitutes the edge 33*a* of the upper exhaust side coolant passage 33 on the intake side is positioned at the highest in the exhaust side coolant passages 32 and 33. Furthermore, the above portion has a substantially straight shape that extends horizontally in the front-back direction and serves as an exhaust side air bleeding passage 33*e* that is an air bleeding passage of the exhaust side coolant passages 32 and 33.

Furthermore, in the end portion passage 332, at portions in each cylinder 2 that are in contact with the exhaust valve guide portions 24 positioned on the backside (the upstream side of the coolant), the edge 33*a* is made to bulge out on the intake side along the outlines of the exhaust valve guide portions 24, and at portions in each cylinder 2 that are in contact with the exhaust valve guide portions 24 positioned on the front side (the downstream side of the coolant), the edge 33*a* is formed in a straight manner. In other words, in the end portion passage 332, the cross-sectional area of the portion in contact with the exhaust valve guide portion 24 that is positioned on the upstream side of the coolant in each cylinder 2 is larger than the cross-sectional area of the portion in contact with the exhaust valve guide portion 24 that is positioned on the downstream side in each cylinder 2, and contraction 33*b* is formed in the portion in contact with the exhaust valve guide portion 24 that is positioned on the downstream side of the coolant in each cylinder 2.

In the inner-block coolant passage 25 and the inner-head coolant passages 30 configured in the above manner, the coolant circulates in a manner illustrated by the black arrows in FIGS. 2 and 3. Described in more detail, in the inner-block coolant passage 25, as illustrated in FIG. 2, most of the coolant that has flowed into the passage body portion 26 from the coolant inlet port 27 flows to the back end side from the front end side of the passage body portion 26 on the intake side, flows around the rearmost cylinder 2, and as illustrated in FIG. 3, flows to the front end side from the back end side of the passage body portion 26 on the exhaust side. Furthermore, as illustrated in FIG. 2, a portion of the coolant that has flowed into the passage body portion 26 from the coolant inlet port 27 passes below the partition member 29 and flows to the exhaust side of the passage body portion 26.

During the above, a portion of the coolant passes through the block first outlet ports 28*a* and the main cylinder inlet ports 34 and flows into the main coolant passage 31 (31*a*, 31*b*, and 31*c*). The coolant that has flowed into the main coolant passage 31 flows, in a unidirectional manner, towards the front end side from the back end side of the main coolant passage 31 and is discharged from the main coolant outlet port 35.

Meanwhile, a portion of the coolant that has reached the front end side of the passage body portion 26 of the inner-block coolant passage 25 on the exhaust side passes through the block second outlet port 28*b* and the exhaust side cylinder inlet port 36 and flows into the lower exhaust side coolant passage 32. The coolant that has flowed into the lower exhaust side coolant passage 32 flows, in a unidirectional manner, towards the back end side from the front end side of the lower exhaust side coolant passage 32, and, at the back end, passes through the vertical communication passage 37 (FIG. 2) and flows into the upper exhaust side coolant passage 33. Then, the coolant flows, in a unidirectional manner, towards the front end side from the back end side of the upper exhaust side coolant passage 33 and is discharged from the exhaust side coolant outlet port 38. In other words, in the exhaust side coolant passages 32 and 33, the coolant flows in a U-shape.

As described above, in the engine E1, the main coolant passage 31 circulates, in a unidirectional manner, the coolant from the inner-block coolant passage 25 through the backside and discharges the coolant from the front side. Meanwhile, in the exhaust side coolant passages 32 and 33, the coolant is, at the front side, made to flow into the lower exhaust side coolant passage 32 from the inner-block coolant passage 25 and, at the backside, is circulated from the lower exhaust side coolant passage 32 to the upper exhaust side coolant passage 33, and at the front side, is circulated to flow out from the upper exhaust side coolant passage 33. With the above, the flow rate of the coolant around each cylinder 2 becomes uniform. Furthermore, since the main coolant passage 31, and the exhaust side coolant passages 32 and 33 are separated from each other and the coolant is distributed only to the main coolant passage 31 and the exhaust side coolant passages 32 and 33 that are practically a single passage, control of distribution is facilitated.

Furthermore, in the exhaust side coolant passages 32 and 33, since the coolant first circulates in the lower exhaust side coolant passage 32 that tends to become relatively high in temperature, the vicinity of the exhaust collection portion 8*b* can be cooled effectively. Furthermore, since the main coolant outlet port 35 of the main coolant passage 31, the exhaust side coolant outlet port 38 of the exhaust side coolant passages 32 and 33, and the coolant inlet port 27 of the inner-block coolant passage 25 are formed on the intake side with respect to the cylinders 2, it is easier to make the layout of the pipes for the coolant.

In the engine E1, when the engine E1 is in a mounted state, the main air bleeding passage 31*e* that extends in the cylinder row direction is formed at the highest position in the main coolant passage 31. Accordingly, even if air were to flow into the main coolant passage 31, the air passes through the main air bleeding passage 31*e* and is discharged from the main coolant passage 31. In a similar manner, when the engine E1 is in a mounted state, the exhaust side air bleeding passage 33*e* that extends in the cylinder row direction is formed in the upper exhaust side coolant passage 33 and at a position that is the highest in the exhaust side coolant passages 32 and 33. Accordingly, even if air were to flow into the exhaust side coolant passages 32 and 33, the air passes through the exhaust side air bleeding passage 33*e* and is discharged from the upper exhaust side coolant passage 33. Note that the above air bleeding passages (31*e*, 33*e*) are formed at a position that is the highest in the main coolant passage 31 or the upper exhaust side coolant passage 33; accordingly, effect to the cooling performance can be suppressed to the minimum.

Furthermore, in the upper exhaust side coolant passage 33 that is formed so as to surround the plurality of exhaust valve guide portions 24 (FIG. 1) individually, as illustrated in FIG. 4, the coolant does not easily flow to the communication passages 333 between the two exhaust valve guide portions 24 provided in each cylinder 2 and the temperature of the cylinder head 4 between the exhaust valves 10 can easily become high; however, in each cylinder 2, the cross-sectional area of the flow path of the end portion passage 332 that is in contact with the exhaust valve guide portion 24 positioned on the upstream side is formed larger than the cross-sectional area of the flow path of the end portion passage 332 that is in contact with the exhaust valve guide portion 24 positioned on the downstream side. With the above, the flow of the coolant in the end portion passage 332 that is in contact with the exhaust valve guide portions 24 positioned on the upstream side can be facilitated and, consequently, flow of the coolant is facilitated in the communication passages 333 between the exhaust valve guide portions 24; accordingly, the portions of the cylinder head 4 between the exhaust valves 10 are effectively cooled.

Furthermore, since each portion in the end portion passage 332 that is in contact with the corresponding exhaust valve guide portion 24 positioned on the downstream side in the corresponding cylinder 2 includes the contraction 33*b*, the coolant that circulates in the end portion passage 332 that is in contact with each of the exhaust valve guide portions 24 positioned on the upstream side can be made to flow more easily to the communication passages 333, and the portion between the exhaust valves 10 of the cylinder head 4 can be cooled in a further effective manner.

Second Exemplary Embodiment

Figure 6:
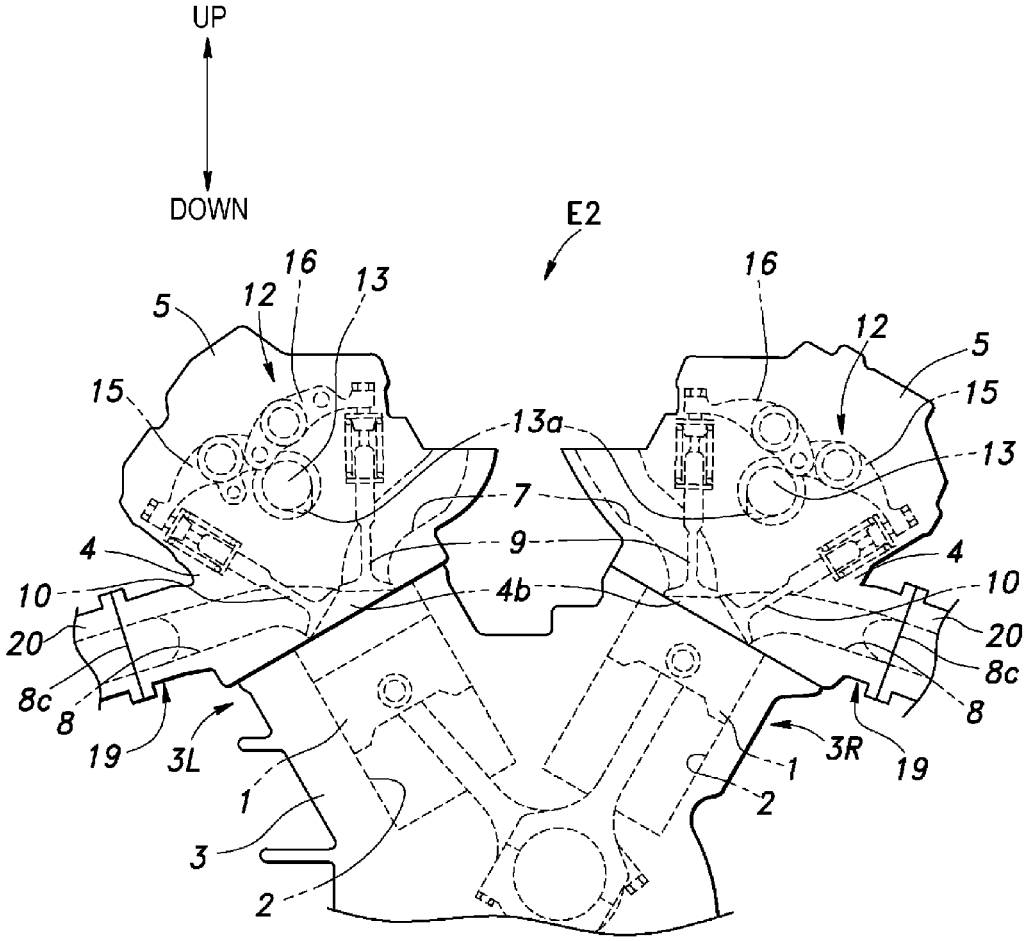
FIG. 6 is a front view of an essential portion of an engine according to a second exemplary embodiment.

A second exemplary embodiment will be described next with reference to FIGS. 6 to 12. As illustrated in FIG. 6, the engine E2 is an SOHC, 4-valve, V6, gasoline engine. Hereinafter, members and portions that correspond to the first exemplary embodiment will be attached with the same reference numerals and redundant description will be omitted. Furthermore, description will be given with reference to FIG. 6 illustrating, in the up-down direction, the engine E2 that is mounted in a vehicle, which will be the standard state herein.

As illustrated in FIG. 6, the engine E2 is formed in a V-shape with a left cylinder bank 3L in which the cylinder block 3 is inclined to the left side in the figure and a cylinder bank 3R in which the cylinder block 3 is inclined to the right side. The cylinder banks 3L and 3R are symmetrical in the left and right and, similar to the cylinder block 3 of the first exemplary embodiment, are each formed with three cylinders 2. Hereinafter, description will be given while L or R that indicate left or right will be attached after the reference numeral for portions and the like that are provided symmetrically in the left and right. Cylinder heads 4L and 4R are fastened to the upper portion of the cylinder bank 3L and 3R, respectively. The cylinder heads 4L and 4R have a left-right symmetrical configuration and are disposed so that the intake sides face each other. Accordingly, compared with the first exemplary embodiment, the exhaust collection ports 8 of the cylinder banks 3L and 3R are further inclined downwards towards the exhaust outlets 8*c* from the combustion chamber recesses 4*b*.

Figure 7:
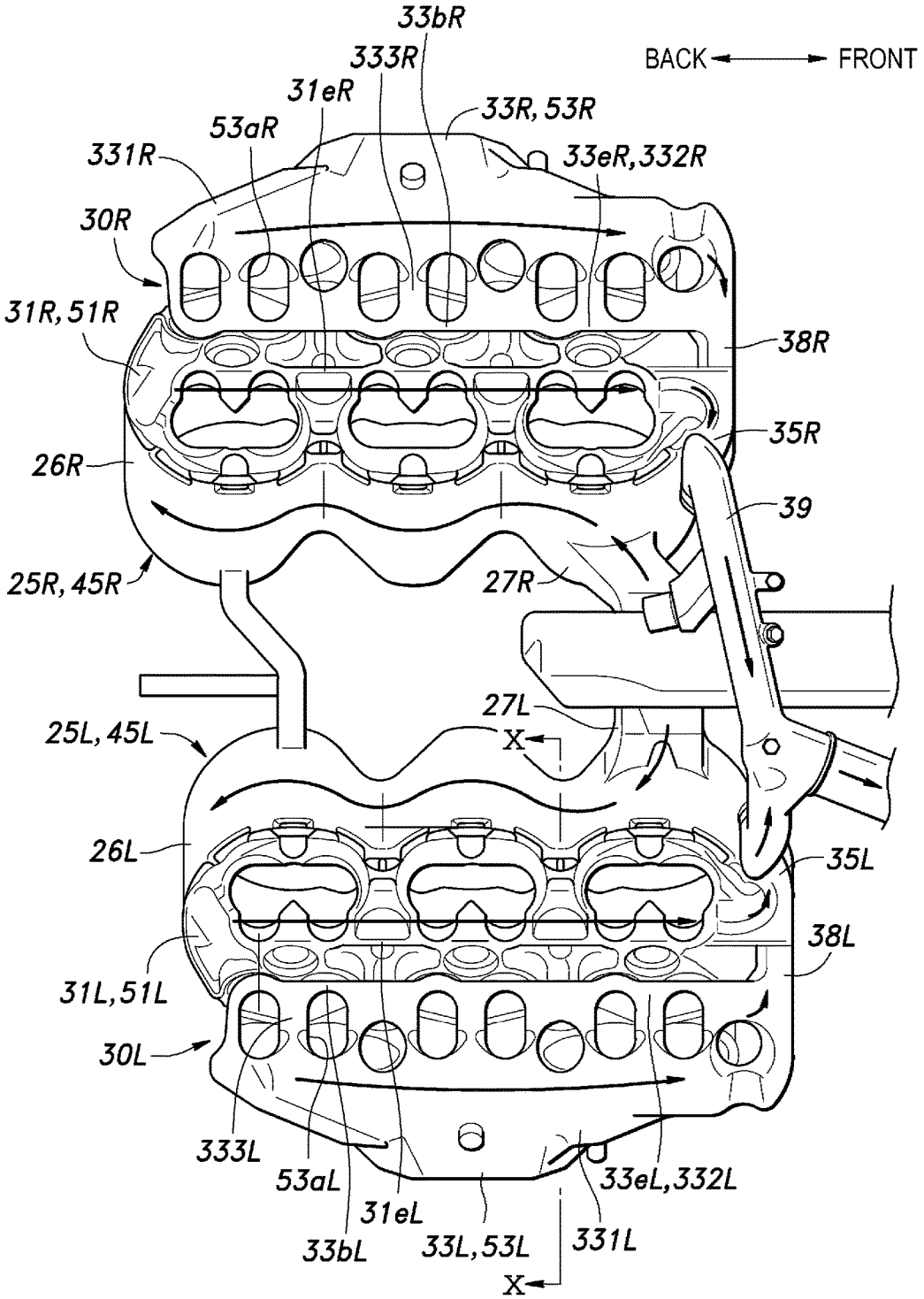
FIG. 7 is a plan view of cores for inner-block coolant passages and inner-head coolant passages.
Figure 8:
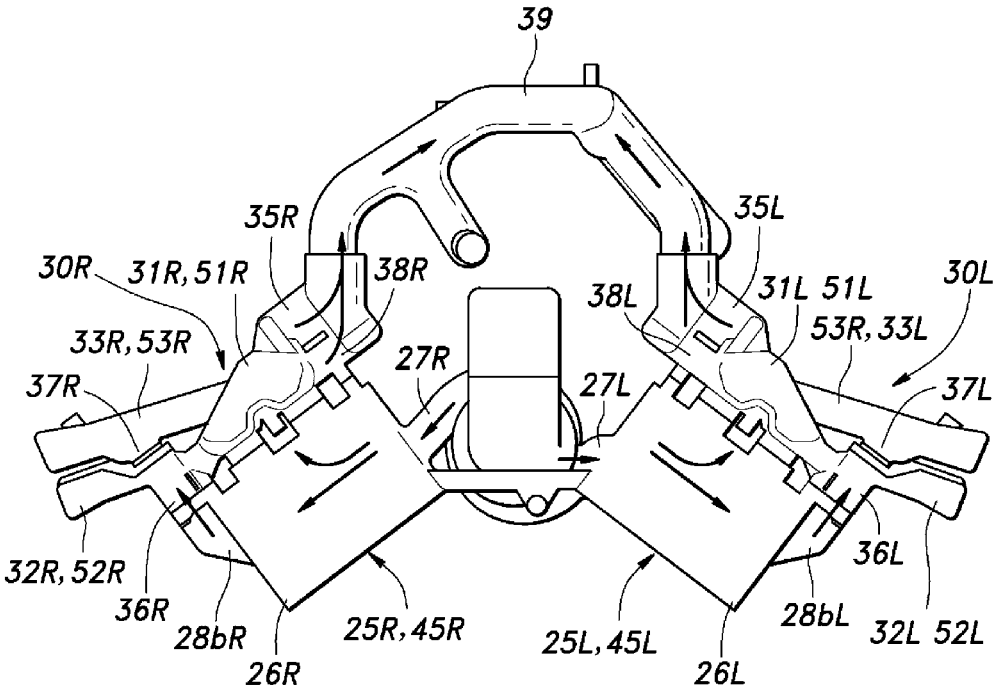
FIG. 8 is a rear view of the cores for the inner-block coolant passages and the inner-head coolant passages.
Figure 9:
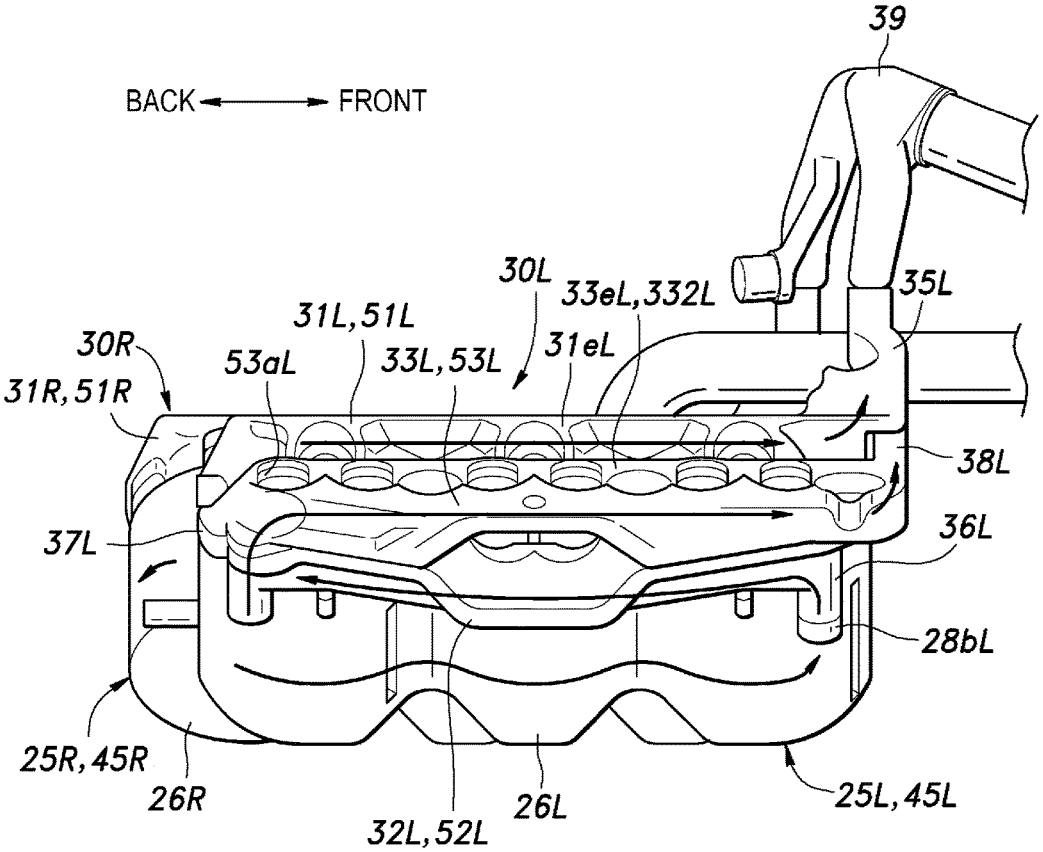
FIG. 9 is a side view of cores for the inner-block coolant passage and the inner-head coolant passage.

As illustrated in FIGS. 7 to 9, inner-block coolant passages 25L and 25R are formed in the cylinder banks 3L and 3R, respectively. In the inner-block coolant passages 25L and 25R, coolant inlet ports 27L and 27R are connected on the lateral sides of the front sides of the passage body portions 26L and 26R on the intake side (in other words, the inner side of the cylinder banks 3L and 3R). Furthermore, main coolant outlet ports 35L and 35R of the inner-block coolant passages 25L and 25R are provided on the front sides of the passage body portions 26L and 26R on the intake side (in other words, the inner side of the cylinder banks 3L and 3R).

Inner-head coolant passages 30L and 30R are formed in the cylinder heads 4L and 4R, respectively. The inner-head coolant passages 30L and 30R respectively include main coolant passages 31L and 31R formed with cores 51L and 51R for main coolant passages, lower exhaust side coolant passages 32L and 32R formed with cores 52L and 52R for lower exhaust side coolant passages, and upper exhaust side coolant passages 33L and 33R formed with cores 53L and 53R for upper exhaust side coolant passages.

Block second outlet ports 28*b*L and 28*b*R of the inner-block coolant passages 25L and 25R, and the exhaust side cylinder inlet ports 36L and 36R that are connected to the above are provided on the front side of the relative passages (25L, 25R, 32L, or 32R) on the exhaust side (in other words, the outer sides of the cylinder banks 3L and 3R). Vertical communication passages 37L and 37R (FIG. 8) communicating the lower exhaust side coolant passages 32L and 32R and the upper exhaust side coolant passages 33L and 33R to each other are provided at the back end of the passages (32L, 32R, 33L or 33R). Furthermore, exhaust side coolant outlet ports 38L and 38R are provided on the front side of the lower exhaust side coolant passages 32L and 32R and the upper exhaust side coolant passages 33L and 33R on the intake side (in other words, the inner sides of the cylinder bank 3L and 3R).

In the inner-block coolant passages 25L and 25R and the inner-head coolant passages 30L and 30R configured in the above manner, the coolant circulates in a manner illustrated by the black arrows in FIGS. 7 to 9. In the left and right inner-block coolant passages 25L and 25R, although the directions in which the coolant flows in the passage body portions 26L and 26R are opposite, each of the flows is similar to that described in the first exemplary embodiment.

Air that has flowed into the main coolant passages 31L and 31R passes through main air bleeding passages 31*e*L and 31*e*R formed at positions that are the highest in the main coolant passages 31L and 31R and is discharged from the main cylinder inlet ports 34L and 34R. Furthermore, air that has flowed into the lower exhaust side coolant passages 32L and 32R and the upper exhaust side coolant passages 33L and 33R passes through the exhaust side air bleeding passages 33*e*L and 33*e*R that are positioned at the highest in the passages and is discharged from the exhaust side coolant outlet ports 38L and 38R.

Figure 10:
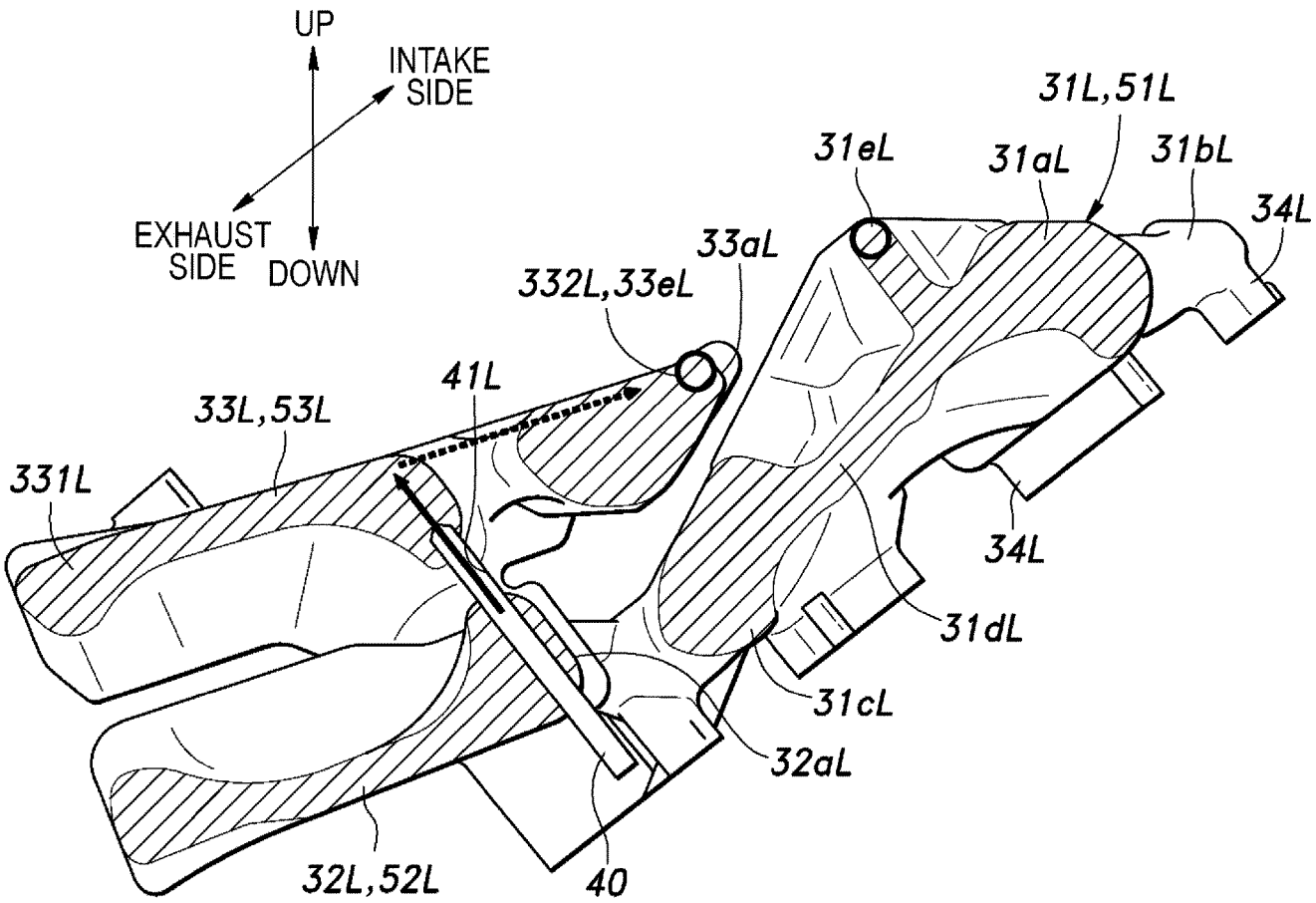
FIG. 10 is a cross sectional view taken along X-X in FIG. 7.
Figure 11:
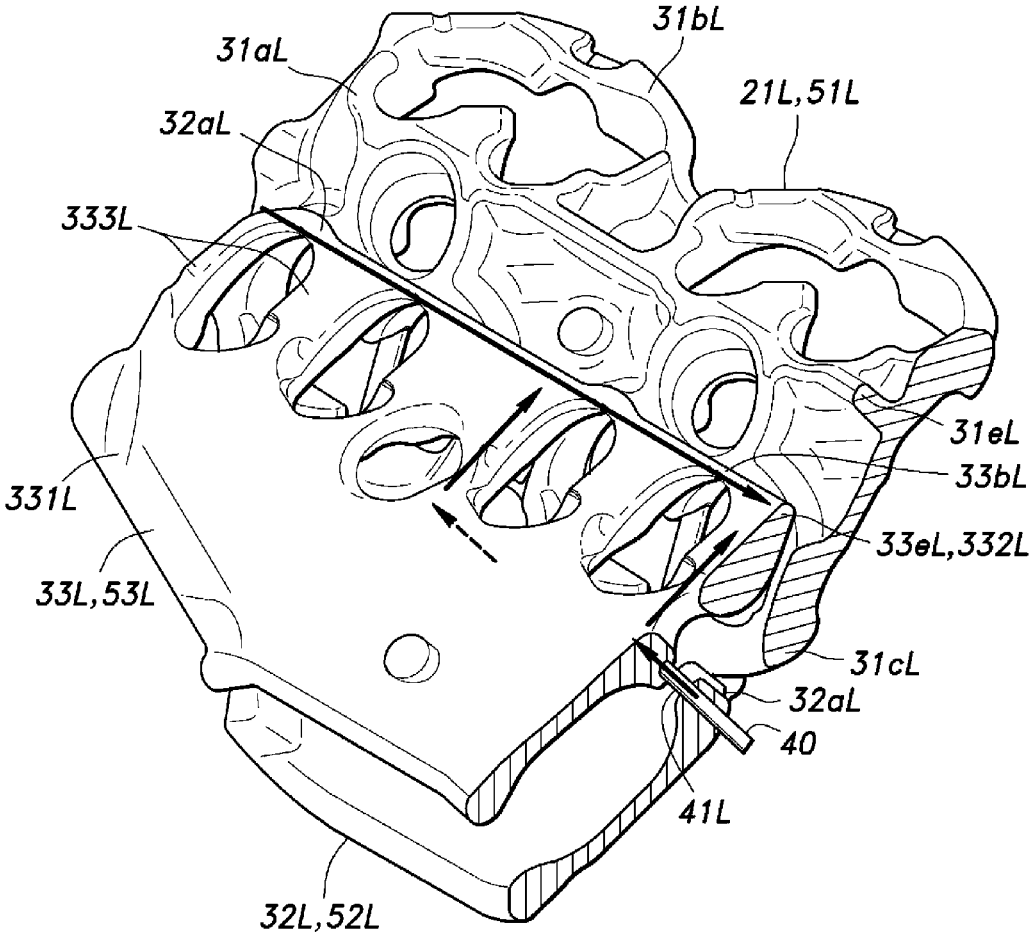
FIG. 11 is an explanatory drawing illustrating a flow of air.

FIG. 10 illustrates a cross-section taken along line X-X in FIG. 7, and FIG. 11 illustrates the inner-head coolant passage 30L (the core 51L for main coolant passage, the core 52L for lower exhaust side coolant passage, and the core 53L for upper exhaust side coolant passage) cut at the same section. As described above, the edge 32*a*L of the lower exhaust side coolant passage 32 on the intake side has a shape extending along the outer edges of the main coolant passage 31L (31*c*L) and the bolt boss for fastening. Because of the above, in the present exemplary embodiment in which the exhaust collection ports 8, in particular, are inclined downwards towards the exhaust outlets 8*c*, the height positions (the highest positions) of the edges 32*a* of the lower exhaust side coolant passages 32 on the intake side shift in the cylinder row direction, and air easily stagnates at the portions before the portions where the height has been lowered. Accordingly, a drill 40 is used to drill a hole in each cylinder head 4 after casting at the highest position in each lower exhaust side coolant passage 32 such that vertical air bleeding passages 41L each in communication with the corresponding upper exhaust side coolant passage 33L are formed. With the above, air that has flowed into the lower exhaust side coolant passages 32L and 32R is allowed to, as illustrated by black arrows in FIGS. 10 and 11, flow through the vertical air bleeding passages 41L and 41R and into the upper exhaust side coolant passages 33L and 33R; accordingly, without stagnation of air, the lower exhaust side coolant passages 32L and 32R can be shaped along the exhaust ports 8*a* and the like to increase the cooling effect.

Furthermore, as illustrated in FIG. 7, in the present exemplary embodiment as well, similar to the first exemplary embodiment, in the end portion passage 332, the cross-sectional area of the portion in contact with the exhaust valve guide portion 24 that is positioned on the upstream side of the coolant in each cylinder 2 is larger than the cross-sectional area of the portion in contact with the exhaust valve guide portion 24 that is positioned on the downstream side in each cylinder 2, and the contraction 33*b* is formed in the portion in contact with the exhaust valve guide portion 24 that is positioned on the downstream side of the coolant in each cylinder 2. Accordingly, the flow of the coolant in the end portion passage 332 portion that is in contact with the exhaust valve guide portions 24 positioned on the upstream side can be facilitated and, consequently, flow of the coolant is facilitated in the communication passages 333 between the exhaust valve guide portions 24; accordingly, the portions of the cylinder head 4 between the exhaust valves 10 are effectively cooled.

Figure 12:
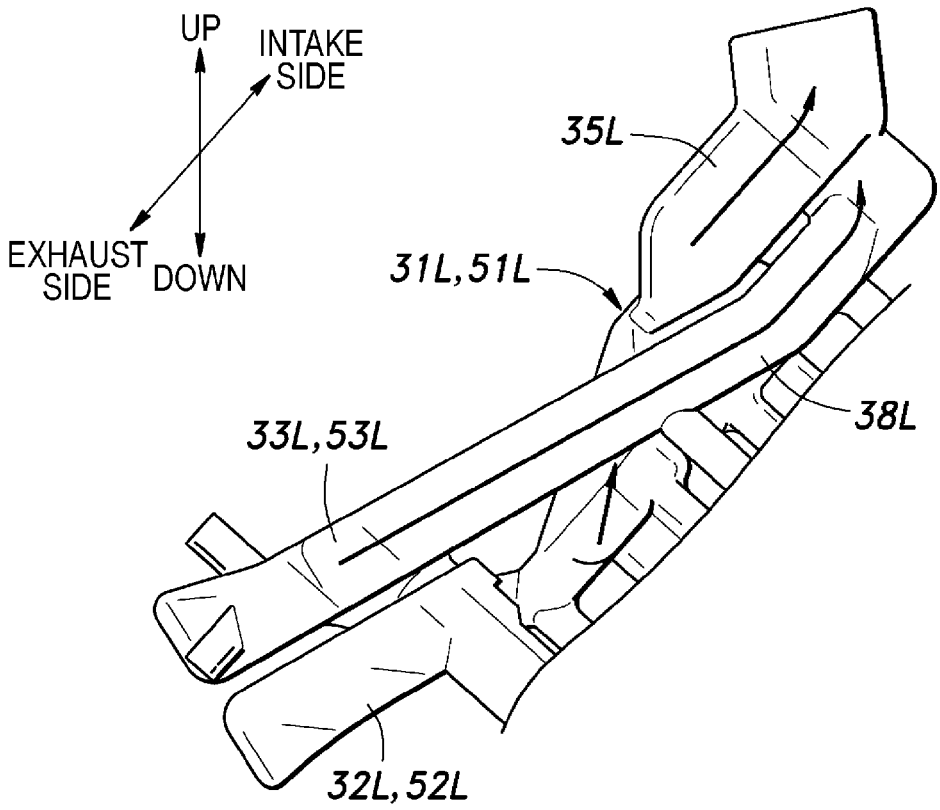
FIG. 12 is an enlarged front view of essential portions of the cores for the inner-block coolant passage and the inner-head coolant passage.

FIG. 12 is an enlarged front view of the essential portions of the inner-block coolant passage 25 and the inner-head coolant passages 30. As illustrated in the drawing, the main coolant outlet port 35L of the main coolant passage 31L, and the lower exhaust side coolant passage 32L and the exhaust side coolant outlet port 38L of the upper exhaust side coolant passage 33L are formed so as to intersect each other when viewed in the cylinder row direction. With the above, even if the upper exhaust side coolant passage 33L is positioned below the main coolant passage 31L, air bleeding of the upper exhaust side coolant passage 33L is facilitated and occurrence of stagnation of air can be suppressed.

While the specific description of the exemplary embodiments is completed, note that a variety of modifications can be implemented without limiting the present disclosure to the exemplary embodiments described above. For example, in the exemplary embodiments described above, while the present disclosure is applied to a 4 valve, in-line 3 cylinder or V6, gasoline engine, the present disclosure may be applied to internal combustion engines of other types used for other purposes. Furthermore, while in the exemplary embodiments described above, only one exhaust outlet 8*c* is formed, two adjacent cylinders 2 may each have two or more exhaust outlets 8*c*, for example. Other than the above, as long as the modification does not depart from the scope of the present disclosure, modifications, such as specific configurations, the dispositions, the numbers, and the angles of the members and portions, may be appropriately made. As regards the components of the internal combustion engine according to the present disclosure that has been illustrated in the exemplary embodiments described above, all of the components do not necessarily have to be a necessity and may be selected appropriately.

The present disclosure describes a cooling structure of an internal combustion engine (E), including a cylinder block (3) in which a plurality of cylinders (2) are formed in a row, the cylinder block having an inner-block coolant passage (25) formed along an outer periphery of the plurality of cylinders; and a cylinder head (4) that is fastened to an upper portion of the cylinder block so as to form combustion chambers (6) between top faces of pistons (1) that slide inside the cylinders, an inner-head coolant passage (30) being formed in the cylinder head. In the cooling structure of the internal combustion engine, a plurality of intake ports (7) each having an upstream end that opens in one lateral side (4*c*) of the cylinder head and a downstream end that is open to a corresponding one of the combustion chambers, a plurality of exhaust ports (8*a*) each having an upstream end that opens to a corresponding one of the combustion chambers, and an exhaust collection portion (8*b*) that merges the plurality of exhaust ports and that has an exhaust outlet (8*c*) open in another lateral side (4*d*) of the cylinder head are formed in the cylinder head, the inner-head coolant passage includes a main coolant passage (31) formed in a portion above the combustion chambers, and a pair of upper and lower exhaust side coolant passages (32, 33) that are formed so as to interpose the exhaust collection portion, the main coolant passage, and the pair of upper and lower exhaust side coolant passages are separated from each other, the main coolant passage (31) circulates a coolant in a unidirectional manner such that the coolant flows from the inner-block coolant passage into one end side (backside) in a cylinder row direction and out from another end side (front side) in the cylinder row direction, and the pair of upper and lower exhaust side coolant passages (32, 33) circulate the coolant such that the coolant flows from the inner-block coolant passage into one of the exhaust side coolant passages at the another end side (front side) in the cylinder row direction, circulates from the one of the exhaust side coolant passages to other one of the exhaust side coolant passages at the one end side (backside) in the cylinder row direction, and flows out from the other one of the exhaust side coolant passages at the another end side (front side) in the cylinder row direction.

According to the above configuration, since the main coolant passage circulates the coolant in a unidirectional manner and the pair of upper and lower exhaust side coolant passages that are connected in series circulates the coolant in a U-shape, the flow rate of the coolant in the vicinities of the cylinders can be made uniform. Furthermore, since the coolant is distributed only to the main coolant passage, and the exhaust side coolant passage that are practically a single passage, control of distribution is facilitated.

Furthermore, in the disclosure described above, the pair of upper and lower exhaust side coolant passages (32, 33) may make the coolant flow into a lower exhaust side coolant passage (32) of the exhaust side coolant passages from the inner-block coolant passage (25) and may make the coolant flow out from an upper exhaust side coolant passage (33) of the exhaust side coolant passages.

According to the above configuration, in the exhaust side coolant passages, since the coolant first circulates in the lower exhaust side coolant passage that tends to become relatively high in temperature, the vicinity of the exhaust collection portion can be cooled effectively.

Furthermore, in the disclosure described above, a coolant outlet port (35) of the main coolant passage, a coolant outlet port (38) of the pair of upper and lower exhaust side coolant passages, and a coolant inlet port (27) of the inner-block coolant passage (25) may be, with respect to the cylinders (2), open on the same side in a direction orthogonal to the cylinder row direction.

According to the above configuration, it is easier to make the layout of the pipes for the coolant.

Furthermore, in the disclosure described above, in a state in which the internal combustion engine is mounted, the main coolant passage (31) may include an air bleeding passage (31*e*) that extends in the cylinder row direction at a position that is highest in the main coolant passage.

According to the above configuration, even if air were to flow into the main coolant passage, the air can be made to flow out from the main coolant passage through the air bleeding passage formed at the highest position. Furthermore, since the air bleeding passage is formed at the highest position, effect to the cooling performance can be suppressed to the minimum.

Furthermore, in the disclosure described above, in a state in which the internal combustion engine is mounted, an upper exhaust side coolant passage (33) of the exhaust side coolant passages may include an air bleeding passage (33*e*) that extends in the cylinder row direction at a position that is highest in the pair of upper and lower exhaust side coolant passages.

According to the above configuration, even if air were to flow into the pair of upper and lower exhaust side coolant passages, the air can be made to flow out from the pair of upper and lower exhaust side coolant passages through the air bleeding passage formed at the highest position. Furthermore, since the air bleeding passage is formed at the highest position, effect to the cooling performance can be suppressed to the minimum.

Furthermore, in the disclosure described above, in a state in which the internal combustion engine is mounted, an air bleeding passage (41) that is in communication with an upper exhaust side coolant passage (33) of the exhaust side coolant passages may be formed at a position that is highest in a lower exhaust side coolant passage (32) of the exhaust side coolant passages.

According to the above configuration, owing to the formation of the air bleeding passage, the air that has flowed into the lower exhaust side coolant passage can flow into the upper exhaust side coolant passage through the air bleeding passage. Accordingly, the lower exhaust side coolant passage can be shaped along the exhaust ports and the like to increase the cooling effect without stagnation of air.

Furthermore, in the disclosure described above, a coolant outlet port (35) of the main coolant passage, and a coolant outlet port (38) of the pair of upper and lower exhaust side coolant passages may intersect each other when viewed in the cylinder row direction.

According to the above configuration, even if the upper exhaust side coolant passage is positioned below the main coolant passage, air bleeding of the exhaust side coolant passage is facilitated and occurrence of stagnation of air can be suppressed.

Furthermore, in the disclosure described above, in the cylinder head, exhaust ports may be formed such that two exhaust ports are open to each combustion chamber, and a plurality of exhaust valve guide portions (24) that support exhaust valves (10) that open and close connection portions between the exhaust ports and the combustion chambers may be formed, an upper exhaust side coolant passage of the exhaust side coolant passages may be formed so as to surround the plurality of exhaust valve guide portions individually and may include a main passage (331) that is formed on the another lateral side (4*d*) of the cylinder head with respect to the plurality of exhaust valve guide portions, an end portion passage (332) that is formed so as to extend in the cylinder row direction and on the one lateral side (4*c*) of the cylinder head with respect to the plurality of exhaust valve guide portions, and a plurality of communication passages (333) that communicate the main passage and the end portion passage to each other, and in each cylinder, a cross-sectional area of a portion of the end portion passage that is in contact with an exhaust valve guide portion of the exhaust valve guide portions that is positioned on an upstream side of the coolant may be larger than a cross-sectional area of a portion of the end portion passage that is in contact with an exhaust valve guide portion of the exhaust valve guide portions that is positioned on a downstream side.

According to the above configuration, in the upper exhaust side coolant passage, since the flow of the coolant in the end portion passage portion that is in contact with the exhaust valve guide portions positioned on the upstream side can be facilitated, flow of the coolant is facilitated in the communication passages between the two exhaust valve guide portions provided in each cylinder; accordingly, the portions of the cylinder head between the exhaust valves are effectively cooled.

Furthermore, in the disclosure described above, in each cylinder, the end portion passage may include a contraction (33*b*) at a portion in contact with the exhaust valve guide portion of the exhaust valve guide portions that is positioned on the upstream side of the coolant.

According to the above configuration, the coolant circulating in the end portion passage portion that is in contact with the exhaust valve guide portions positioned on the upstream side can flow to the communication passage more easily; accordingly, the portion of the cylinder head between the exhaust valves can be cooled in a further effective manner.

Furthermore, the present disclosure describes a cooling structure of an internal combustion engine (E), including a cylinder block (3) in which a plurality of cylinders (2) are formed in a row, the cylinder block having an inner-block coolant passage (25) formed along an outer periphery of the plurality of cylinders; and a cylinder head (4) that is fastened to an upper portion of the cylinder block so as to form combustion chambers (6) between top faces of pistons (1) that slide inside the cylinders, an inner-head coolant passage (30) being formed in the cylinder head. In the cooling structure of the internal combustion engine (E), a plurality of intake ports (7) each having an upstream end that opens in one lateral side (4*c*) of the cylinder head and a downstream end that is open to a corresponding one of the combustion chambers, a plurality of exhaust ports (8*a*), two upstream ends of the plurality of exhaust ports being open to each combustion chamber, an exhaust collection portion (8*b*) that merges the plurality of exhaust ports and that has an exhaust outlet (8*c*) open in another lateral side of the cylinder head, and a plurality of exhaust valve guide portions (24) that support exhaust valves (10) that open and close connection portions between the exhaust ports and the combustion chambers are formed in the cylinder head, the inner-head coolant passage includes a main coolant passage (31) formed in a portion above the combustion chambers, and a pair of upper and lower exhaust side coolant passages (32, 33) that are formed so as to interpose the exhaust collection portion, at least an upper exhaust side coolant passage (33) of the exhaust side coolant passages is separated from the main coolant passage, is formed so as to surround the plurality of exhaust valve guide portions individually, and is configured to circulate a coolant in a cylinder row direction, the upper exhaust side coolant passage of the exhaust side coolant passages includes a main passage (331) that is formed on the another lateral side of the cylinder head with respect to the plurality of exhaust valve guide portions, an end portion passage (332) that is formed so as to extend in the cylinder row direction and on the one lateral side of the cylinder head with respect to the plurality of exhaust valve guide portions, and a plurality of communication passages (333) formed so as to communicate the main passage and the end portion passage to each other at a portion between adjacent exhaust valve guide portions, in each cylinder, a cross-sectional area of a portion of the end portion passage that is in contact with an exhaust valve guide portion of the exhaust valve guide portions that is positioned on an upstream side of the coolant is larger than a cross-sectional area of a portion of the end portion passage that is in contact with an exhaust valve guide portion of the exhaust valve guide portions that is positioned on a downstream side.

In the upper exhaust side coolant passage that is formed so as to surround the plurality of exhaust valve guide portions individually, the coolant does not easily flow to the communication passages between the two exhaust valve guide portions provided in each cylinder and the temperature of the cylinder head between the exhaust valves can easily become high; however, according to the above configuration, the flow of the coolant to the portions of the end portion passage that are in contact with the exhaust valve guide portions positioned on the upstream side in each cylinder is facilitated and the portions of the cylinder head between the exhaust valves can be effectively cooled.

Furthermore, in the disclosure described above, in each cylinder, the end portion passage may include a contraction (33*b*) at a portion in contact with the exhaust valve guide portion of the exhaust valve guide portions that is positioned on the upstream side of the coolant.

According to the above configuration, the coolant circulating in the end portion passage portion that is in contact with the exhaust valve guide portions positioned on the upstream side can flow to the communication passage more easily; accordingly, the portion of the cylinder head between the exhaust valves can be cooled in a further effective manner.

As described above, according to the present disclosure, in an internal combustion engine in which an exhaust collection portion is formed in the cylinder head, a cooling structure that enables the flow rate of a coolant in the vicinity of each cylinder be made uniform and the distribution control of the coolant be facilitated can be provided.

Obviously, numerous modifications and variations of the present invention are possible in light of the above teachings. It is therefore to be understood that within the scope of the appended claims, the invention may be practiced otherwise than as specifically described herein.

What is claimed is:

1. A cooling structure of an internal combustion engine, comprising:

a cylinder block in which a plurality of cylinders are formed in a row, the cylinder block having an inner-block coolant passage formed along an outer periphery of the plurality of cylinders; and a cylinder head that is fastened to an upper portion of the cylinder block so as to form combustion chambers between top faces of pistons that slide inside the cylinders, an inner-head coolant passage being formed in the cylinder head, wherein a plurality of intake ports each having an upstream end that opens in one lateral side of the cylinder head and a downstream end that is open to a corresponding one of the combustion chambers, a plurality of exhaust ports each having an upstream end that opens to a corresponding one of the combustion chambers, and an exhaust collection portion that merges the plurality of exhaust ports and that has an exhaust outlet open in another lateral side of the cylinder head are formed in the cylinder head, the inner-head coolant passage includes a main coolant passage formed in a portion above the combustion chambers, and a pair of upper and lower exhaust side coolant passages that are formed so as to interpose the exhaust collection portion in the cylinder head, the main coolant passage, and the pair of upper and lower exhaust side coolant passages are separated from each other, the main coolant passage circulates a coolant in a unidirectional manner such that the coolant flows from the inner-block coolant passage into one end side in a cylinder row direction and out from another end side in the cylinder row direction, and the pair of upper and lower exhaust side coolant passages circulate the coolant such that the coolant flows first from the inner-block coolant passage into one of the exhaust side coolant passages at the another end side in the cylinder row direction, subsequently circulates from the one of the exhaust side coolant passages to an other one of the exhaust side coolant passages at the one end side in the cylinder row direction, and subsequently flows out from the other one of the exhaust side coolant passages at the another end side in the cylinder row direction.

2. The cooling structure of an internal combustion engine according to claim 1, wherein the pair of upper and lower exhaust side coolant passages makes the coolant flow into a lower exhaust side coolant passage of the exhaust side coolant passages from the inner-block coolant passage and makes the coolant flow out from an upper exhaust side coolant passage of the exhaust side coolant passages.

3. The cooling structure of an internal combustion engine according to claim 1, wherein a coolant outlet port of the main coolant passage, a coolant outlet port of the pair of upper and lower exhaust side coolant passages, and a coolant inlet port of the inner-block coolant passage are, with respect to the cylinders, open on a same side in a direction orthogonal to the cylinder row direction.

4. The cooling structure of an internal combustion engine according to claim 1, wherein in a state in which the internal combustion engine is mounted, the main coolant passage includes an air bleeding passage that extends in the cylinder row direction at a position that is highest in the main coolant passage.

5. The cooling structure of an internal combustion engine according to claim 1, wherein in a state in which the internal combustion engine is mounted, an upper exhaust side coolant passage of the exhaust side coolant passages includes an air bleeding passage that extends in the cylinder row direction at a position that is highest in the pair of upper and lower exhaust side coolant passages.

6. The cooling structure of an internal combustion engine according to claim 1, wherein in a state in which the internal combustion engine is mounted, an air bleeding passage that is in communication with an upper exhaust side coolant passage of the exhaust side coolant passages is formed at a position that is highest in a lower exhaust side coolant passage of the exhaust side coolant passages.

7. The cooling structure of an internal combustion engine according to claim 1, wherein a coolant outlet port of the main coolant passage, and a coolant outlet port of the pair of upper and lower exhaust side coolant passages intersect each other when viewed in the cylinder row direction.

8. The cooling structure of an internal combustion engine according to claim 1, wherein in the cylinder head, exhaust ports are formed such that two exhaust ports are open to each combustion chamber, and a plurality of exhaust valve guide portions that support exhaust valves that open and close connection portions between the exhaust ports and the combustion chambers are formed, an upper exhaust side coolant passage of the exhaust side coolant passages is formed so as to surround the plurality of exhaust valve guide portions individually and includes a main passage that is formed on the another lateral side of the cylinder head with respect to the plurality of exhaust valve guide portions, an end portion passage that is formed so as to extend in the cylinder row direction and on the one lateral side of the cylinder head with respect to the plurality of exhaust valve guide portions, and a plurality of communication passages that communicate the main passage and the end portion passage to each other, and in each cylinder, a cross-sectional area of a portion of the end portion passage that is in contact with an exhaust valve guide portion of the exhaust valve guide portions that is positioned on an upstream side of the coolant is larger than a cross-sectional area of a portion of the end portion passage that is in contact with an exhaust valve guide portion of the exhaust valve guide portions that is positioned on a downstream side.

9. The cooling structure of an internal combustion engine according to claim 8, wherein in each cylinder, the end portion passage includes a contraction at a portion in contact with the exhaust valve guide portion of the exhaust valve guide portions that is positioned on the upstream side of the coolant.

10. A cooling structure of an internal combustion engine, comprising: a cylinder block in which a plurality of cylinders are formed in a row, the cylinder block having an inner-block coolant passage formed along an outer periphery of the plurality of cylinders; and a cylinder head that is fastened to an upper portion of the cylinder block so as to form combustion chambers between top faces of pistons that slide inside the cylinders, an inner-head coolant passage being formed in the cylinder head, wherein a plurality of intake ports each having an upstream end that opens in one lateral side of the cylinder head and a downstream end that is open to a corresponding one of the combustion chambers, a plurality of exhaust ports, two upstream ends of the plurality of exhaust ports being open to each combustion chamber, an exhaust collection portion that merges the plurality of exhaust ports and that has an exhaust outlet open in another lateral side of the cylinder head, and a plurality of exhaust valve guide portions that support exhaust valves that open and close connection portions between the exhaust ports and the combustion chambers are formed in the cylinder head, the inner-head coolant passage includes a main coolant passage formed in a portion above the combustion chambers, and a pair of upper and lower exhaust side coolant passages that are formed so as to interpose the exhaust collection portion, at least an upper exhaust side coolant passage of the exhaust side coolant passages is separated from the main coolant passage, is formed so as to surround the plurality of exhaust valve guide portions individually, and is configured to circulate a coolant in a cylinder row direction, the upper exhaust side coolant passage of the exhaust side coolant passages includes a main passage that is formed on the another lateral side of the cylinder head with respect to the plurality of exhaust valve guide portions, an end portion passage that is formed so as to extend in the cylinder row direction and on the one lateral side of the cylinder head with respect to the plurality of exhaust valve guide portions, and a communication passage formed so as to communicate the main passage and the end portion passage to each other at a portion between adjacent exhaust valve guide portions, in each cylinder, a cross-sectional area of a portion of the end portion passage that is in contact with an exhaust valve guide portion of the exhaust valve guide portions that is positioned on an upstream side of the coolant is larger than a cross-sectional area of a portion of the end portion passage that is in contact with an exhaust valve guide portion of the exhaust valve guide portions that is positioned on a downstream side, the main coolant passage circulates the coolant in a unidirectional manner such that the coolant flows from the inner-block coolant passage into one end side in a cylinder row direction and out from another end side in the cylinder row direction, and the pair of upper and lower exhaust side coolant passages circulate the coolant such that the coolant flows first from the inner-block coolant passage into one of the exhaust side coolant passages at the another end side in the cylinder row direction, subsequently circulates from the one of the exhaust side coolant passages to an other one of the exhaust side coolant passages at the one end side in the cylinder row direction, and subsequently flows out from the other one of the exhaust side coolant passages at the another end side in the cylinder row direction.

11. The cooling structure of an internal combustion engine according to claim 10, wherein in each cylinder, the end portion passage includes a contraction at a portion in contact with the exhaust valve guide portion of the exhaust valve guide portions that is positioned on the upstream side of the coolant.

12. A cooling structure of an internal combustion engine, comprising: a cylinder block in which cylinders are provided in a row in a cylinder row direction;

an inner-block coolant passage which is provided in the cylinder block along an outer periphery of the cylinders and through which a coolant is to flow;

a cylinder head connected to an upper portion of the cylinder block so as to provide combustion chambers between the cylinder head and top faces of pistons that are slidable inside the cylinders, the cylinder head comprising:

an intake lateral side surface;

an exhaust lateral side surface;

intake ports each having an upstream end and a downstream end, the upstream end opening on the intake lateral side surface, the downstream end opening to one of the combustion chambers;

exhaust ports each having an upstream end that opens to one of the combustion chambers; and an exhaust collection portion merging the exhaust ports and having an exhaust outlet that opens on the exhaust lateral side surface; and an inner-head coolant passage provided in the cylinder head and comprising:

a main coolant passage provided above the combustion chambers and extending in the cylinder row direction so that the coolant flows into the main coolant passage from the inner-block coolant passage at a first end side of the cylinder head in the cylinder row direction and so that the coolant flows out from the main coolant passage at a second end side of the cylinder head opposite to the first end side in the cylinder row direction; and an upper exhaust side coolant passage and a lower exhaust side coolant passage which are provided so as to interpose the exhaust collection portion, which are separated from the main coolant passage, and which extend in the cylinder row direction so that the coolant first flows into one of the upper and the lower exhaust side coolant passages from the inner-block coolant passage at the second end side, so that the coolant subsequently circulates from the one of the upper and the lower exhaust side coolant passages to an other one of the upper and the lower exhaust side coolant passages at the first end side, and so that the coolant subsequently flows out from the other one of the upper and the lower exhaust side coolant passages at the second end side.

13. The cooling structure according to claim 12, wherein the upper and the lower exhaust side coolant passages are constructed so that the coolant flows into the lower exhaust side coolant passage from the inner-block coolant passage and so that the coolant flows out from the upper exhaust side coolant passage.

14. The cooling structure according to claim 12, wherein a coolant outlet port of the main coolant passage, a coolant outlet port of one of the upper and the lower exhaust side coolant passages, and a coolant inlet port of the inner-block coolant passage are, with respect to the cylinders, open on a side in a direction orthogonal to the cylinder row direction.

15. The cooling structure according to claim 12, wherein in a state in which the internal combustion engine is mounted, the main coolant passage includes an air bleeding passage that extends in the cylinder row direction at a position that is highest in the main coolant passage.

16. The cooling structure according to claim 12, wherein in a state in which the internal combustion engine is mounted, the upper exhaust side coolant passage includes an air bleeding passage that extends in the cylinder row direction at a position that is highest in the upper and the lower exhaust side coolant passages.

17. The cooling structure according to claim 12, wherein in a state in which the internal combustion engine is mounted, an air bleeding passage that is in communication with the upper exhaust side coolant passage is provided at a position that is highest in the lower exhaust side coolant passage.

18. The cooling structure according to claim 12, wherein a coolant outlet port of the main coolant passage, and a coolant outlet port of one of the upper and the lower exhaust side coolant passages intersect each other when viewed in the cylinder row direction.

19. The cooling structure according to claim 12, wherein in the cylinder head, the exhaust ports are constructed so that each of the exhaust ports has two openings that open to one of the combustion chambers, and exhaust valve guide portions that support exhaust valves that open and close connection portions between the exhaust ports and the combustion chambers are provided, wherein the upper exhaust side coolant passage is constructed so as to surround each of the exhaust valve guide portions and includes a main passage that is provided on a side of the exhaust lateral side surface of the cylinder head with respect to the exhaust valve guide portions, an end portion passage that is provided on a side of the intake lateral side surface of the cylinder head with respect to the exhaust valve guide portions so as to extend in the cylinder row direction and, and communication passages that connect the main passage and the end portion passage, and wherein above one of the cylinders, a cross-sectional area of a portion of the end portion passage that is in contact with an exhaust valve guide portion of the exhaust valve guide portions that is positioned on an upstream side of the coolant is larger than a cross-sectional area of a portion of the end portion passage that is in contact with an exhaust valve guide portion of the exhaust valve guide portions that is positioned on a downstream side of the coolant.

20. The cooling structure according to claim 19, wherein above the one of the cylinders, the end portion passage includes a contraction at a portion in contact with the exhaust valve guide portion of the exhaust valve guide portions that is positioned on the upstream side of the coolant.

21. A cooling structure of an internal combustion engine, comprising: a cylinder block in which cylinders are provided in a row in a cylinder row direction;

an inner-block coolant passage provided in the cylinder block along an outer periphery of the cylinders;

a cylinder head connected to an upper portion of the cylinder block so as to provide combustion chambers between the cylinder head and top faces of pistons that are slidable inside the cylinders, the cylinder head comprising:

an intake lateral side surface;

an exhaust lateral side surface;

intake ports each having an upstream end and a downstream end, the upstream end opening on the intake lateral side surface, the downstream end opening to one of the combustion chambers;

exhaust ports each having two upstream ends that open to one of the combustion chambers;

an exhaust collection portion merging the exhaust ports and having an exhaust outlet that opens on the exhaust lateral side surface; and exhaust valve guide portions supporting exhaust valves provided to open and close connection portions between the exhaust ports and the combustion chambers; and an inner-head coolant passage provided in the cylinder head and comprising:

a main coolant passage provided above the combustion chambers; and an upper exhaust side coolant passage and a lower exhaust side coolant passage that are provided so as to interpose the exhaust collection portion, the upper exhaust side coolant passage being separated from the main coolant passage, being provided so as to surround each of the exhaust valve guide portions, and extending in the cylinder row direction so that a coolant circulates through the upper exhaust side coolant passage in the cylinder row direction, the upper exhaust side coolant passage comprising:

a main passage provided on a side of the exhaust lateral side surface of the cylinder head with respect to the exhaust valve guide portions;

an end portion passage provided on a side of the intake lateral side surface of the cylinder head with respect to the exhaust valve guide portions so as to extend in the cylinder row direction; and a communication passage provided so as to connect the main passage and the end portion passage between a first exhaust valve guide portion and a second exhaust valve guide portion which are among the exhaust valve guide portions and which are adjacent to each other above one of the cylinders, the first exhaust valve guide portion and the second exhaust valve guide portion being positioned on an upstream side of the coolant and on a downstream side of the coolant, respectively, a cross-sectional area of a first portion of the end portion passage that is in contact with the first exhaust valve guide portion being larger than a cross-sectional area of a second portion of the end portion passage that is in contact with the second exhaust valve guide portion, wherein the main coolant passage circulates the coolant in a unidirectional manner such that the coolant flows from the inner-block coolant passage into one end side in a cylinder row direction and out from another end side in the cylinder row direction, and the pair of upper and lower exhaust side coolant passages circulate the coolant such that the coolant flows first from the inner-block coolant passage into one of the exhaust side coolant passages at the another end side in the cylinder row direction, subsequently circulates from the one of the exhaust side coolant passages to an other one of the exhaust side coolant passages at the one end side in the cylinder row direction, and subsequently flows out from the other one of the exhaust side coolant passages at the another end side in the cylinder row direction.

22. The cooling structure according to claim 21, wherein above the one of the cylinders, the end portion passage includes a contraction at a portion in contact with the second exhaust valve guide portion of the exhaust valve guide portions.

23. The cooling structure of an internal combustion engine according to claim 1, wherein the exhaust collection portion in the cylinder head is disposed between the pair of upper and lower exhaust side coolant passages in a vertical direction of the internal combustion engine.

24. The cooling structure of an internal combustion engine according to claim 1, wherein an entirety of the flow that circulates from the one of the exhaust side coolant passages enters the other one of the exhaust side coolant passages at the one end side in the cylinder row direction.

25. The cooling structure of an internal combustion engine according to claim 1, wherein the pair of upper and lower exhaust side coolant passages are connected in series to each other so as to form a U-shaped coolant flow path.

* * * * *